US011684919B2

(12) United States Patent
Cottier

(10) Patent No.: US 11,684,919 B2
(45) Date of Patent: Jun. 27, 2023

(54) METHODS AND ASSEMBLIES FOR HIGH THROUGHPUT SCREENING

(71) Applicant: Creoptix AG, Wädenswil (CH)

(72) Inventor: Kaspar Cottier, Wädenswil (CH)

(73) Assignee: Creoptix AG, Wädenswil (CH)

( * ) Notice: Subject to any disclaimer, the term of this patent is extended or adjusted under 35 U.S.C. 154(b) by 370 days.

(21) Appl. No.: 16/772,179

(22) PCT Filed: Dec. 13, 2018

(86) PCT No.: PCT/IB2018/060002

§ 371 (c)(1),
(2) Date: Jun. 12, 2020

(87) PCT Pub. No.: WO2019/116296

PCT Pub. Date: Jun. 20, 2019

(65) Prior Publication Data

US 2021/0086180 A1 Mar. 25, 2021

(30) Foreign Application Priority Data

Dec. 15, 2017 (CH) ..... CH01541/17

(51) Int. Cl.
*B01L 3/00* (2006.01)
*B01L 3/02* (2006.01)

(52) U.S. Cl.
CPC ..... *B01L 3/502715* (2013.01); *B01L 3/0293* (2013.01); *B01L 3/50273* (2013.01);
(Continued)

(58) Field of Classification Search
None
See application file for complete search history.

(56) References Cited

U.S. PATENT DOCUMENTS 7,858,372 B2 12/2010 Whalen
8,325,347 B2 12/2012 Cottier
(Continued)

FOREIGN PATENT DOCUMENTS

WO WO-2007/076188 A2 7/2007
WO WO-2008/110026 A1 9/2008
(Continued)

OTHER PUBLICATIONS

International Search Report and Written Opinion for PCT/IB2018/060002 dated Mar. 19, 2019, 10 pages.

*Primary Examiner* — Rebecca M Giere
*Assistant Examiner* — Xiaoyan Zou
(74) *Attorney, Agent, or Firm* — Blank Rome LLP

(57) ABSTRACT

Methods for screening a plurality of sample fluids for molecules which can bind to predefined ligands, comprising, selecting one of a plurality of flow cell groups by fluidly connecting the selected flow cell group to a sample delivery unit; injecting a sample fluid to be screened from the sample delivery unit into the flow cells in the selected flow cell group; for each flow cell in the selected flow cell group, recording a signal using a sensor which represents the binding and/or the dissociation of molecules of the sample fluid to/from ligands on the test surface of that flow cell; carrying out a damage assessment step using said recorded signals; if it is determined that the test surface of a flow cell in the selected flow cell group is damaged, then fluidly connecting the other flow cell group to the sample delivery unit. There is further provided assemblies which can be used to implement the afore-mentioned methods.

11 Claims, 4 Drawing Sheets

(52) U.S. Cl.
CPC . *B01L 2200/143* (2013.01); *B01L 2300/0829* (2013.01); *B01L 2300/0877* (2013.01); *B01L 2400/049* (2013.01); *B01L 2400/0633* (2013.01)

(56) References Cited

U.S. PATENT DOCUMENTS

| | | | | |
|---|---|---|---|---|
| 2005/0019933 | A1 | 1/2005 | Andersson et al. | |
| 2015/0192574 | A1 | 7/2015 | Cottier | |
| 2015/0353608 | A1* | 12/2015 | Watanabe | C07K 16/4208 435/235.1 |
| 2016/0347851 | A1* | 12/2016 | Heusser | A61P 37/06 |
| 2017/0176317 | A1 | 6/2017 | Shah et al. | |

FOREIGN PATENT DOCUMENTS

| | | | |
|---|---|---|---|
| WO | WO-2017/050940 | A1 | 3/2017 |
| WO | WO-2017/187325 | A1 | 11/2017 |

* cited by examiner

METHODS AND ASSEMBLIES FOR HIGH THROUGHPUT SCREENING

RELATED APPLICATIONS

This application is a national phase of PCT/M2018/060002, filed on Dec. 13, 2018, which claims the benefit of Swiss Application No. CH015411/17, filed on Dec. 15, 2017. The entire contents of these applications are hereby incorporated by reference.

FIELD OF THE INVENTION

The present invention concerns methods an assemblies for high throughput screening of fluidic samples, and in particular, to assemblies which have a plurality of groups of flow cells and each group can be individually addressed; and methods of screening which involve checking for damage to test surface in a flow cell of a flow cell group, and if the check shows that a test surface of a flow cell in the group is damaged then addressing another flow cell group in the assembly, and using said other flow cell group to screen the next fluidic sample.

DESCRIPTION OF RELATED ART

In many applications, such as drug discovery and development, environmental testing, and diagnostics, there is a need to analyse a large number of liquid samples in a short amount of time. Devices for delivering the samples are generally called autosamplers or auto-injectors and are interfaced to all manner of analysis systems including, but not limited to, optical or acoustic biosensors, mass spectrometers, chromatography systems, and spectrophotometric detectors.

Biosensors and related analytical instruments for molecular interaction analysis are well known in the art. Often such systems are based on optical sensors, which probe the local refractive index near a sensor surface. This refractive index is changed by the presence of analyte molecules, typically when binding to a target molecule, which has previously been attached or immobilized on or near the sensor surface. The attached molecule is often referred to as ligand. Usually, one or several surfaces or measurement channels present ligand of interest, while the other channels serve as reference, to cancel out parasitic effects such as buffer refractive index mismatches. By recording the refractive index changes over time and fitting the obtained data to an interaction model, the molecular interaction can be characterized. In particular, the kinetic on- and off-rates ka and kd can be determined, as well as the affinity of the (biochemical) system.

A representative example of a modern surface-based system for molecular interaction analysis is the Creoptix™ WAVEdelta which makes use of waveguide interferometry for high resolution readout, and smart microfluidics for broadest sample compatibility. A description of the working principle of such an optical sensor can be found in WO2008110026, and a description of such a microfluidic assembly and injection methods are given in PCT/IB2017/052353 (WO2017/187325).

Fluidic assemblies for biosensing applications typically comprise a flow cell. The flow cell is a solid support having a microfluidic channel defined therein; and at least a portion of the surface which defines the microfluidic channel defines a test surface which can be probed using a sensor. The test surface is adapted to receive ligands through immobilization or capture approaches. Once immobilized or captured on the test surface, the ligands can bind to predefined molecules. Sample fluids are passed through the flow cell and if said predefined molecules are present in that sample fluid they will become bound to the ligands within the flow cell. Thus, it can be determined if a sample fluid contains the predefined molecule by passing the sample fluid through the flow cell and detecting if the ligands in the flow cell have bound to molecules as the sample fluid flows through the flow cell. Alternatively, if the sample fluid contains known concentrations of the predefined molecules, it can be determined if the predefined molecules bind to the ligands, or the kinetics of the molecular binding between the ligands and predefined molecules can be analysed. Typically, it will be desired to consecutively screen a plurality of sample fluids; for each sample fluid it will need to be picked up, using a hollow needle for example, and then passed through the flow cell; then the needle (and flow cell) must be cleaned before the next sample fluid is screened.

Recently, the high throughput screening of molecular interactions has gained increased interest, in particular in pharmaceutical companies where drug to drug-target interactions are studied in drug discovery. During high throughput screening, typically a large number of predefined molecules, which in this case are drug candidates, are prepared at a single concentration such as 100 micromolar or 100 nanomolar, and successively evaluated for binding to a ligand which is in this case a drug target. If a binding event is detected, the candidate molecule is marked as a hit and further investigated.

Examples of higher throughput systems for screening applications include the Biacore® 8 k instrument, a method for operating which is described in WO2017050940, or the Sierra Sensors MASS-2 instrument, for which the flow cell configuration is described in U.S. Pat. No. 7,858,372B2. Both mentioned instruments are based on the effect of Surface Plasmon Resonance (SPR). However, the devices suffer from several limitations which make manual intervention necessary. In particular, test surfaces can fail, e.g. due to compounds binding irreversibly to the surface, which needs to be detected and the chip manually exchanged. Also, the ligands may gradually lose their bioactivity (i.e. their capacity to bind predefined molecules) over time. Both issues often require the repetition of a screening experiment several times until all drug candidates have been evaluated. In addition, since the throughput increase is obtained by simple parallelization on these devices, parallel injections pass over different test surfaces which might present different characteristics, e.g. different target immobilization levels, and thus the results can become difficult to compare.

It is an aim of the present invention to at least mitigate some of the above-mentioned disadvantages.

BRIEF DESCRIPTION OF THE DRAWINGS

The invention will be better understood with the aid of a description of embodiments, which are given by way of example only, and illustrated by the figures, in which.

DETAILED DESCRIPTION OF POSSIBLE EMBODIMENTS OF THE INVENTION

Figure 1:
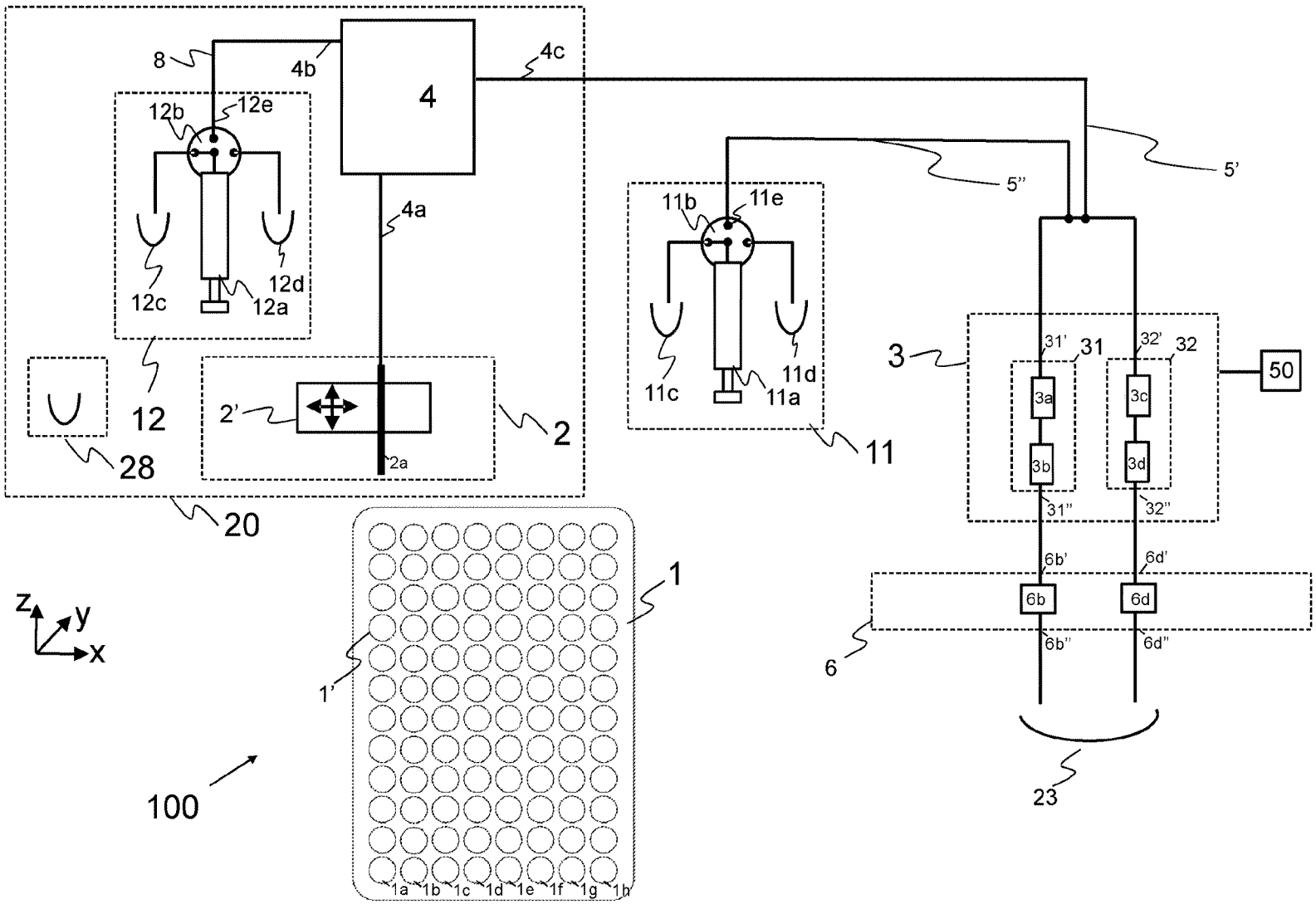
FIG. 1 provides a schematic view of a fluidic assembly according to an embodiment of the present invention.

FIG. 1 provides a schematic view of a fluidic assembly 100 according to one embodiment of the present invention, which is suitable for biochemical sensing (e.g. high throughput biochemical sensing), such as, for instance, screening for unknown molecules having a high affinity towards the ligands, or detection or quantification of known molecules at unknown concentrations in a sample fluids binding to the ligands. Examples include testing small molecule drug candidate binding to a drug target, such as screening of a pharmaceutical compound library; or Fragment Based Screening, a relatively novel technique which is described in detail in Perspicace et al., J Biomol Screen. 2009 April; 14(4):337-49.

The fluidic assembly 100 comprises a sample container 1 comprising a plurality of wells 1' each of which can hold a sample fluid. The sample container 1 is typically in the form of a micro well plate, such as industry standard 96-well or 384-well micro titer plates, or in the form of a plurality of vials. The wells 1' of the sample container 1 are typically filled with sample fluids by a user either manually or by means of an automated liquid handling station. Typically, the wells 1' of the sample container 1 are all sealed by placing a foil over the sample container 1 which prevents the sample fluids from flowing out of the respective wells 1'; or the wells 1' of the sample container 1 are all sealed by means of a septum (which is provided at the mouth of each well 1'); septums are typically provided in case of vials, in order to avoid concentration mismatches due to evaporation. In the exemplary embodiment in FIG. 1, the sample container 1 comprises 96 wells (e.g. is a 96-well micro titer plate), containing twelve rows of eight wells 1' each. The first row of wells contains a first well 1*a*, a second well 1*b*, a third well 1*c*, a fourth well 1*d*, a fifth well 1*e*, a sixth well 1*f*, a seventh well 1*g*, and an eighth well 1*h*.

Furthermore, the fluidic assembly 100 comprises a flow cell unit 3, which comprises a at least two flow cell groups 31,32. In the depicted embodiment, the flow cell unit 3 comprises two flow cell groups 31,32, a first flow cell group 31 and a second flow cell group 32. Each flow cell group comprises at least two flow cells. In the depicted embodiment, the first flow cell group 31 comprises a first flow cell 3*a* and a second flow cell 3*b*, and the second flow cell group 32 comprises a third flow cell 3*c* and a fourth flow cell 3*d*.

It is understood that the flow cell unit 3 may also comprise any number of flow cell groups greater than one; for example the flow cell unit 3 may comprise more than two flow cell groups 31,32; for example the flow cell until may comprise three flow cell groups, four flow cell groups, five flow cell groups, six flow cell groups, eight flow cell groups, ten flow cell groups, twelve flow cell groups, sixteen flow cell groups, thirty-two flow cell groups or ninety-six flow cell groups.

It is also understood that each flow cell group may comprise any number of flow cells greater than one; for example each flow cell group in the flow cell unit 3 may comprise more than two flow cells, in particular each flow cell group in the flow cell unit 3 may comprise three flow cells, four flow cells, eight flow cells, ten flow cells, twelve flow cells, sixteen flow cells, thirty-two flow cells or ninety-six flow cells.

In the assembly 100 the flow cell 3*a*,*b* and 3*c*,*d* belonging to each group 31,32 are fluidly connected in series. Each flow cell group 31,32 comprises a fluidic inlet port (31', 32') and a fluidic outlet port (31", 32"); the flow cells of that respective flow cell group 31,32 are fluidly connected in series between the fluidic inlet port (31', 32') and the fluidic outlet port (31", 32") of that respective group. In each flow cell group 31,32 the fluidic inlet port (31', 32') of that flow cell group is fluidly connected to the fluidic outlet port (31", 32") of that flow cell group via the flow cells which are connected in series between the fluidic inlet port (31', 32') and fluidic outlet port (31", 32").

The fluidic assembly 100 furthermore comprises a sample delivery unit 20, which is fluidly connected to the flow cell unit 3 by means of a sample delivery conduit 5'. In the embodiment depicted in FIG. 1, the sample delivery conduit 5' is connected to the fluidic inlet port (31') of the first flow cell group 31 and to the fluidic inlet port (32') of the second flow cell group 32. The sample delivery unit 20 is adapted to selectively deliver sample fluids present in the plurality of sample reservoirs 1*a*-*h* of the sample container 1 to the flow cell unit 3 through the sample delivery conduit 5'.

In the embodiment depicted in FIG. 1, the sample delivery unit 20 comprises a needle unit 2. The needle unit 2 comprises at least one needle, which is configured to fit into each respective well 1' of the sample container 1. In the embodiment depicted in FIG. 1, the needle unit 2 comprises a first needle 2*a* (however it will be understood that the needle unit 2 may comprise a plurality of needles—for example the number of needles in the needle unit 2 may correspond to the number of wells 1' in a row of the sample container 1). The first needle 2*a* is typically in the form of a conduit which is open at its free end so that fluid can be aspirated into the first needle 2*a* via the opening. The first needle 2*a*, maybe a stainless steel needle or a PEEK tube with a bottom opening. Preferably, the first needle 2*a* is configured so that it can pierce a foil or a septum which may be sealing the a respective well 1' in the sample container 1. Preferably the needle unit 2 can be moved with respect to sample container 1 such as to selectively dip the first needle 2*a* into corresponding wells 1, typically using a robotic arm or xyz-table on which the needle unit is mounted to move the needle unit 2 while the sample container 1 is stationary, or using a robotic arm or xyz table to move the sample container 1 while the needle unit 2 is stationary.

The needle unit 2 further comprises a moveable stage 2', which is used to position the needle unit 2 with respect to the sample container 1, and with respect to a wash station 28. The moveable stage configured either, such that it is operable to selectively move the needle unit 2, while the sample container 1 and/or the wash station 28 remain substantially stationary (i.e. selectively move the needle unit 2 with respect to the sample container 1 and the wash station 28), or such that it is operable to move the sample container 1 and/or the wash station 28 while the needle unit 2 remains substantially stationary (i.e. selectively move the sample container 1 and/or the wash station 28 with respect to the needle unit 2). The moveable stage 2' may comprise a robotic arm or a xyz table. The wash station 28 is a station at which the needle unit 2 (in particular the first needle 2*a* of the needle unit 2 can be washed); the wash station 28 may comprise one or more wells which have drains for removing excess liquid, and/or comprise fluidic input ports for supplying washing liquids to the needle unit 2 which clean the needle unit 2. The wash station 28 may comprise several stations such as a first wash station for washing the needle unit 2 with an active wash liquid such as a detergent, and a second wash station for rinsing the needle unit 2 with a buffer fluid.

In the embodiment depicted in FIG. 1, the sample delivery unit 20 further comprises a first pumping means 12 having an output 12*e*. The first pumping means 12 is configured so that it is selectively operable to provide positive pressure (e.g. positive fluid pressure) or negative pressure (e.g. negative fluid pressure) at its output 12*e*. The first pumping means 12 may have any suitable configuration. In this example, the first pumping means 12 comprises a syringe 12*a*, a switching valve 12*b*, a buffer reservoir 12*c* which contains a buffer fluid, a waste reservoir 12*d* and an output 12*e*.

Preferably, during use of the assembly 100, before operating the first pumping means 12 to provide a positive pressure at its output 12*e*, the first pumping means 12 is first primed by configuring the switching valve 12*b* to fluidly connect the syringe 12*a* to the waste reservoir 12*d*, so as to allow buffer fluid to pass from the syringe 12*a* to the waste reservoir 12*d*; then the buffer fluid contents of the syringe 12*a* are dispensed into the waste reservoir 12*d*. Then the switching valve 12*b* is configured to fluidly connect the syringe 12*a* to the buffer reservoir 12*c*, so as to allow buffer fluid to pass from the buffer reservoir 12*c* to the syringe 12*a*. The syringe 12*a* is then filled with buffer fluid from the buffer reservoir 12*c* by aspirating buffer fluid from the buffer reservoir 12*c*.

In order to configure the first pumping means 12 to provide positive pressure at its output 12*e*, the switching valve 12*b* is configured to fluidly connect the syringe 12*a* to the output 12*e*; the buffer fluid contained in the syringe 12*a* is then dispensed from the syringe; the dispense buffer fluid creates the positive pressure at the output 12*e*.

Similarly, preferably, during use of the assembly 100, before operating the first pumping means 12 to provide negative pressure at the output 12*e*, the syringe 12*a* is typically at least partially emptied (and most preferably is fully emptied); the switching valve 12*b* is configured to fluidly connect the syringe 12*a* to the waste reservoir 12*d* so as to allow fluid to pass from the syringe 12*a* to the waste reservoir 12*d*; the fluid contents of the syringe 12*a* is then at least partially emptied into the waste reservoir 12*d*. In order to provide negative pressure, the switching valve 12*b* is configured to fluidly connect the syringe 12*a* to the output 12*e*; fluid present in the output 12*e* is aspirated into the syringe 12*a*; aspirating fluid from the output 12*e* into the syringe 12*a* creates the negative pressure at the output 12*e*.

In the embodiment depicted in FIG. 1, the sample delivery unit 20 further comprises an injector valve 4 which comprises three fluidic ports, a first fluidic port 4*a* which is fluidly connected to the needle unit 2, a second fluidic port 4*b* which is connected to the output 12*e* of the first pumping means 12 by means of a conduit 8 (which, for the purposes of clarity, is referred to hereafter as a sample loop conduit 8), and a third fluidic port 4*c* which is fluidly connected to the sample delivery conduit 5'.

The injector valve 4 is configured so that it can be selectively arranged to fluidly connect the second fluidic port 4*b* to either the first fluidic port 4*a* or the third fluidic port 4*c*: The injector valve 4 is movable between a first position and a second position; when the injector valve 4 is in its first position the second fluidic port 4*b* is fluidly connected to the first fluidic port 4*a*, when the injector valve 4 is in its second position the second fluidic port 4*b* is fluidly connected to the third fluidic port 4*c*.

The injector valve 4 may take any suitable for: In an embodiment, the injector valve 4 comprises a rotary valve (such as a known rotary valve which is available in the art). In such a case, in order to move the injector valve 4 into its first or second positions a the rotor of the rotary valve is selectively positioned using a motor versus a stator; specifically the rotor of the rotary valve is selectively positioned using a motor versus a stator so that the rotary valve is either in its first position (wherein the second fluidic port 4*b* is fluidly connected to the first fluidic port 4*a* via the rotary valve), or in its second position (wherein the second fluidic port 4*b* is fluidly connected to the third fluidic port 4*c* via the rotary valve) as desired.

In an embodiment, the injector valve 4 comprises two 2/2 solenoid valves or pinch valves with an inlet port and an outlet port, whereas the solenoid valve can be selectively opened or closed in order to allow, or block, fluid passage between the input port and the outlet port, respectively. The 2/2 solenoid valves provided in the injector valve 4 may be 2/2 solenoid valves which are known in the art. In this embodiment, the inlet port of a first solenoid valve is connected to the first port 4*a*, and the outlet port of the first solenoid valve is connected to the second port 4*b*, and the inlet port of a second solenoid valve is connected to the third port 4*b*, and the outlet port of the first solenoid valve is connected to the second port 4*b*. In order to move the injector valve 4 into the first position, the first solenoid valve is opened and the second solenoid valve is closed, and in order to move the injector valve 4 into the second position, the first solenoid valve is closed and the second solenoid valve is opened.

It is understood that the sample delivery unit may take any form; the only requirement is that the sample delivery unit must be selectively operable to retrieve one or more sample fluids present in the plurality of sample reservoirs of the sample container 1 and pass said retrieved sample fluid(s) to the flow cell unit 3 via the sample delivery conduit 5'.

The fluidic assembly 100 furthermore preferably comprises a second pumping means 11 which has an output 11*e*, which is fluidly connected to the flow cell unit 3 by means of a buffer delivery conduit 5". The buffer delivery conduit 5" is connected to the first end of the first flow cell group 31' and the first end of the second flow cell group 32'. The second pumping means 11 is configured so that it is selectively operable to provide positive pressure (e.g. positive fluid pressure) or negative pressure (e.g. negative fluid pressure) at its output 11*e*. The second pumping means 11 may have any suitable configuration. In this example, the second pumping means 11 comprises a syringe 11*a*, a switching valve 11*b*, a buffer reservoir 11*c* which contains a buffer fluid, a waste reservoir 11*d* and an output 11*e*.

Preferably, during use of the assembly 100, before operating the second pumping mean 11 to provide a positive pressure at its output 11*e*, the second pumping means 11 is first primed by configuring the switching valve 11*b* to fluidly connect the syringe 11*a* to the waste reservoir 11*d*, so as to allow buffer fluid to pass from the syringe 11*a* to the waste reservoir 11*d*; then the buffer fluid contents of the syringe 11*a* are dispensed into the waste reservoir 11*d*. Then the switching valve 11*b* is configured to fluidly connect the syringe 11*a* to the buffer reservoir 11*c*, so as to allow buffer fluid to pass from the buffer reservoir 11*c* to the syringe 11*a*. The syringe 11*a* is then filled with buffer fluid from the buffer reservoir 11*c* by aspirating buffer fluid from the buffer reservoir 11*c*. In order to provide positive pressure, the switching valve 11*b* is then configured to fluidly connect the syringe 11*a* to the output 11*e*; the buffer fluid contained in the syringe 11*a* is then dispensed from the syringe; the dispense buffer fluid creates the positive pressure at the output 11*e*.

Similarly, during use of the assembly 100, preferably, before providing negative pressure at the output 11*e*, the syringe 11*a* is typically at least partially emptied (and most preferably is fully emptied); the switching valve 11*b* is configured to fluidly connect the syringe 11*a* to the waste reservoir 11*d* so as to allow fluid to pass from the syringe 11*a* to the waste reservoir 11*d*; the fluid contents of the syringe 11*a* is then at least partially emptied into the waste reservoir 11*d*. In order to provide negative pressure, the switching valve 11*b* is configured to fluidly connect the syringe 11*a* to the output 11*e*; fluid present in the output 11*e* is aspirated into the syringe 11*a*; aspirating fluid from the output 11*e* into the syringe 11*a* creates the negative pressure at the output 11*e*.

The fluidic assembly 100 furthermore comprises a group selector valve unit 6, which is configured to selectively allow or block passage of fluid through any of the flow cell groups (31,32). The group selector valve unit 6 is moveable between at least as many positions as there are flow cell groups; thus in the fluidic assembly 100 since there are two flow cell groups (31,32) the selector valve unit 6 is moveable between at least two position. Specifically, in this example the selector valve unit 6 is moveable between a first position and a second position: when the group selector valve unit 6 is in its first position, fluid can flow through the first flow cell group 31, while fluid is blocked from flowing through the second flow cell group 32. When the group selector valve unit 6 is in its second position, fluid is blocked from flowing through the first flow cell group 31, while fluid can flow through the second flow cell group 32

In the assembly 100, order to 'select' (or 'address') the first flow cell group 31 the group selector valve unit 6 is arranged into its first position. In order to 'select' (or 'address') the second flow cell group 32 the group selector valve unit 6 is arranged into its second position.

In the assembly 100, the group selector valve unit 6 comprises a first group selector valve 6*b* and a second group selector valve 6*d* (the first group selector valve 6*b* and second group selector valve 6*d* are each, preferably, 2/2 solenoid valves). When the group selector valve unit 6 is in its first position, the first group selector valve 6*b* is in its open state thus allowing fluid to flow through the first flow cell group 31, and the second group selector valve 6*b* is in its closed state thus blocking fluid from flowing through the second flow cell group 32. When the group selector valve unit 6 is in its second position, the first group selector valve 6*b* is in its closed state thus blocking the flow of fluid through the first flow cell group 31, and the second group selector valve 6*b* is in its open state thus allowing fluid to flow through the second flow cell group 32.

In the depicted embodiment, the first group selector valve 6*b* comprises an input 6*b*' which is fluidly connected to the outlet port 31" of the first flow cell group 31, and has an output 6*b*" which is fluidly connected to a waste container 23. The second group selector valve 6*d* comprises an input 6*d*' which is fluidly connected to the outlet port 32" of the second flow cell group 32, and has an output 6*d*" which is fluidly connected to a waste container 23.

Each flow cell within the cell unit 3 comprises a test surface which may comprise ligands (i.e. ligands may be immobilized on the test surface). The ligands can bind to molecules of a sample fluid which have a predefined characteristic such as having a high affinity to the ligands either via a simple lock-and-key mechanism where a molecule fits into a so-called binding pocket of a ligand, or assisted by more complex molecular processes such as conformational changes. Thus, it can be determined which molecules in a sample fluid have said predefined characteristic of having a high affinity to the ligands, by passing the sample fluid over the surfaces of the flow cell unit 3 and then determining which molecules have become bound to the ligands. In drug discovery applications where a multitude of molecules from a compound library are screened for finding suitable drug candidates binding to a drug target, typically, different ligands can be used to exclude non-specific binding effects, for instance by providing a drug target as ligands, and similar molecules as the drug target but lacking a specific binding pocket.

Importantly, in this application, in each and every embodiment of the invention, each flow cell group 31,32 comprises, at least one flow cell which has a first type of ligands which could potentially bind to molecules of a sample fluid (the purpose of the screening is to determine if these first type of ligands do bind to molecules which are, a priori, known to be present in the samples which are to be screened); and at least another flow cell which serves as a reference flow cell. The reference flow cell either has no ligands on its test surface, or has reference ligands bound to its test surface, wherein reference ligands are a second type of ligand which are different to the first type of ligand. In this application the reference ligand is defined as being a second type of ligand which is different to the first type of ligand. Most preferably the first type of ligand will be identical to a protein (target protein) which is in the human body, and the sample to be screened will contain predefined molecules (the predefined molecules typically are contained in a pharmaceutical drug which is under test); for a drug under test, to be effective in treatment of the human body then the predefined molecules must be able to bind to the first type of ligands. The second type of ligand could be slightly different (but still very similar) to said first ligand; in other words the second type of ligand could be slightly different (but still very similar) to said target protein. For the drug under test, to be effective in treatment of the human body then the predefined molecules must also not bind to the second type of ligands. If the predefined molecules do bind to the first type of ligands when the sample flows through the said at least one flow cell, and if the predefined molecules do not bind to the second type of ligands when the sample flows through the reference flow cell, then it can be concluded that if the drug was administered to a patient then the predefined molecules would bind specifically to said target protein and not to similar proteins, and the drug would therefore be effective in treating the patient.

In the assembly 100 for example, in the first flow cell group 31, the first flow cell 3*a* serves as a reference flow cell, it has no ligands (or reference ligands) on its test surface; the second flow cell 3*b* has ligands on its test surface which can bind to molecules of sample fluids; in the first flow cell group 33, the third flow cell 3*c* serves as a reference flow cell, it has no ligands (or reference ligands) on its test surface; the fourth flow cell 3*d* has ligands on its test surface which can bind to molecules of sample fluids.

In a preferred embodiment, the fluidic assembly further comprises a chip which comprises all surfaces which may comprise ligands. The ligands are preferably captured or immobilized on the test surface of each flow cell using an immobilization reagent; for example the ligands are preferably captured or immobilized on the test surface of each flow cell using amine coupling within a thin hydrogel layer such as a Dextran layer covalently bound to the surface within a flow cell; or in another preferred exemplary embodiment the ligands are captured by a suitable tag such as biotin or hexahistidine or glutathione-S-transferase within a gel matrix such as Agarose within the volume of a flow cell. Thus, ultimately, in each flow cell, the ligands are preferably indirectly attached to the test surfaces of that flow cell via an immobilization reagent, as is already well known in the art. A detailed overview of coupling chemistries, reagents and protocols can be found in Schaasfort, "Handbook of Surface Plasmon Resonance", RSC publishing, 2017. The ligands can be selectively captured or immobilized off-line, such as by removing the chip from the fluidic assembly and by printing the ligands onto the desired test surfaces by means of an inkjet printer or a micro-array spotter, as is already well known in the art.

In the preferred embodiment the fluidic assembly 100 furthermore comprises a sensor 50 (such as a Surface Plasmon Resonance sensor, or, Waveguide interferometry sensor, or, surface acoustic sensor) which is configured to measure if molecules have become bound to the ligands on the test surface of a flow cell 3*a-d* within the flow cell unit 3 (most preferably the sensor 50 is configured to measure if molecules have become bound to the ligands on the test surface of any of the flow cells 3*a*-3*d* within the flow cell unit 3); said sensor is preferably operably connected to the flow cell unit 3 so that it can perform such measurements. The signal which is output from the sensor represents the binding of molecules to the ligands on the test surface of that flow cell, and/or dissociation of molecules which were bound to the ligands on the test surface of that flow cell.

In a variation of this embodiment, wherein the fluidic assembly further comprises a chip which comprises all surfaces which may comprise ligands, the sensor 50 is operably connected to the chip so that it can perform such measurements.

Figure 2:
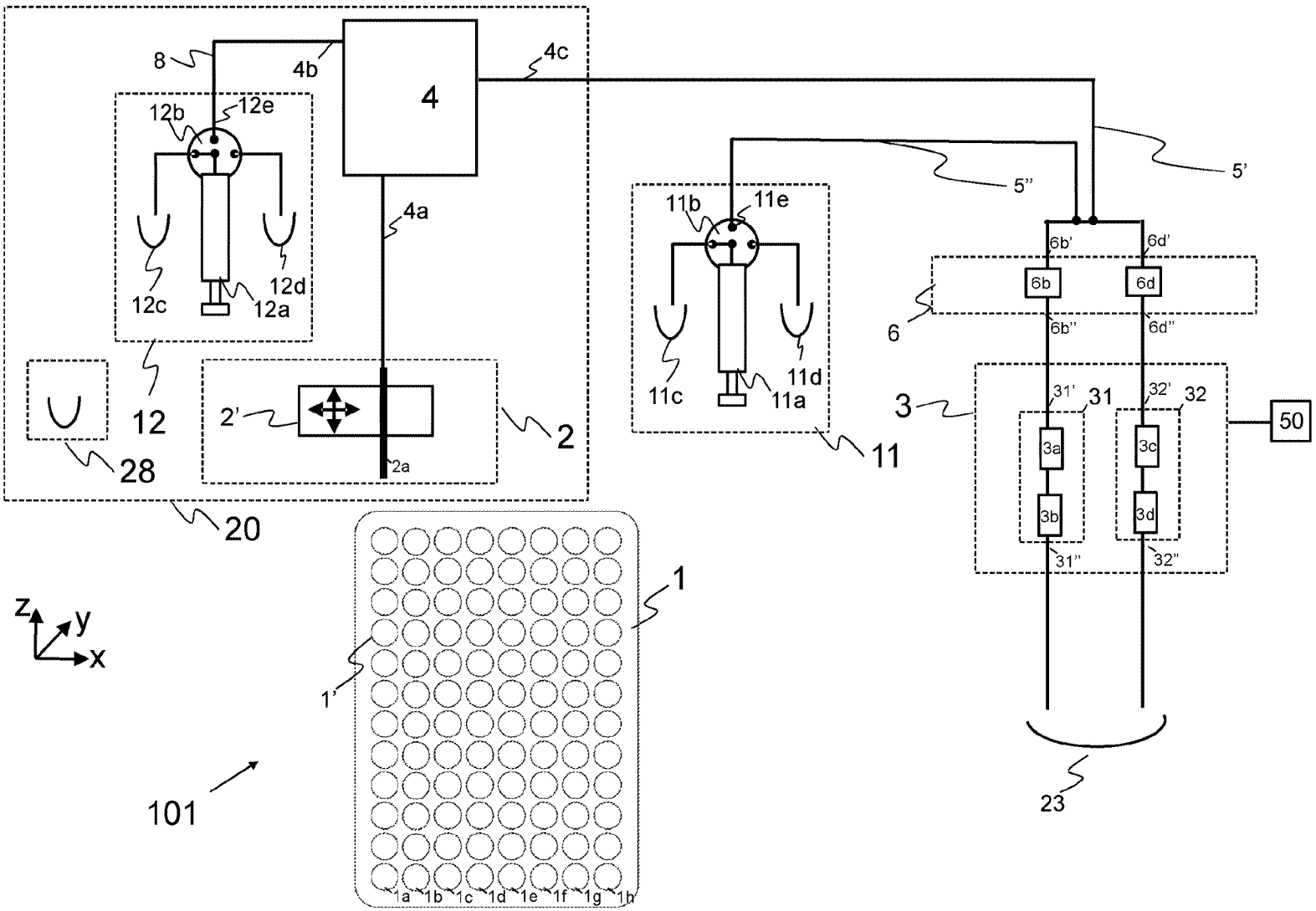
FIG. 2 provides a schematic view of a fluidic assembly according to another embodiment of the present invention.

FIG. 2 provides a schematic view of a fluidic assembly 101 according to another embodiment of the present invention, which is suitable for biochemical sensing (e.g. high throughput biochemical sensing). The fluidic assembly 101 has many of the same features as the fluidic assembly 100 shown in FIG. 1, and like features are awarded the same reference numbers.

In the fluidic assembly 101, the group selector valve unit 6 is located upstream from the flow cell unit 3 (whereas, in contrast, in the fluidic assembly 100 of FIG. 1 the group selector valve unit 6 is located downstream from the flow cell unit 3). In particular, in the fluidic assembly 101, the input 6*b*' of the first group selector valve 6*b* is fluidly connected to the sample inlet conduit 5' and is also fluidly connected to the buffer inlet conduit 5"; the output 6*b*" of the first group selector valve 6*b* is fluidly connected to the input port 31' of the first flow cell group 31 (so that the first group selector valve 6*b* is fluidly connected to the first flow cell group 31). The input 6*d*' of the second group selector valve 6*d* is fluidly connected to the sample inlet conduit 5' and is also fluidly connected to the buffer inlet conduit 5"; the output 6*d*" of the second group selector valve 6*d* is fluidly connected to the input port 32' of the second flow cell group 32 (so that the second group selector valve 6*d* is fluidly connected to the second flow cell group 32).

The selector valve unit 6 is moveable between a first position and a second position: when the group selector valve unit 6 is in its first position, fluid can flow through the first flow cell group 31, while fluid is blocked from flowing through the second flow cell group 32. In other words when the group selector valve unit 6 is in its first position, fluid can flow through the first group selector valve 6*b* and into the flow cells 3*a,b* of the first flow cell group 31; while the second group selector valve 6*d* being closed blocks the flow of fluid into the flow cells 3*c,d* of the second flow cell group. When the group selector valve unit 6 is in its second position, fluid is blocked from flowing through the first flow cell group 31, while fluid can flow through the second flow cell group 32. In other words when the group selector valve unit 6 is in its second position words fluid can flow through the second group selector valve 6*d* and into the flow cells 3*c,d* of the second flow cell group 31; while the first group selector valve 6*b* being closed blocks the flow of fluid into the flow cells 3*a,b* of the first flow cell group 31. Thus, as was the case for assembly 100 of FIG. 1, in the assembly 102 of FIG. 2, to order to 'select' (or 'address') the first flow cell group 31 the group selector valve unit 6 is arranged into its first position. In order to 'select' (or 'address') the second flow cell group 32 the group selector valve unit 6 is arranged into its second position.

Figure 3:
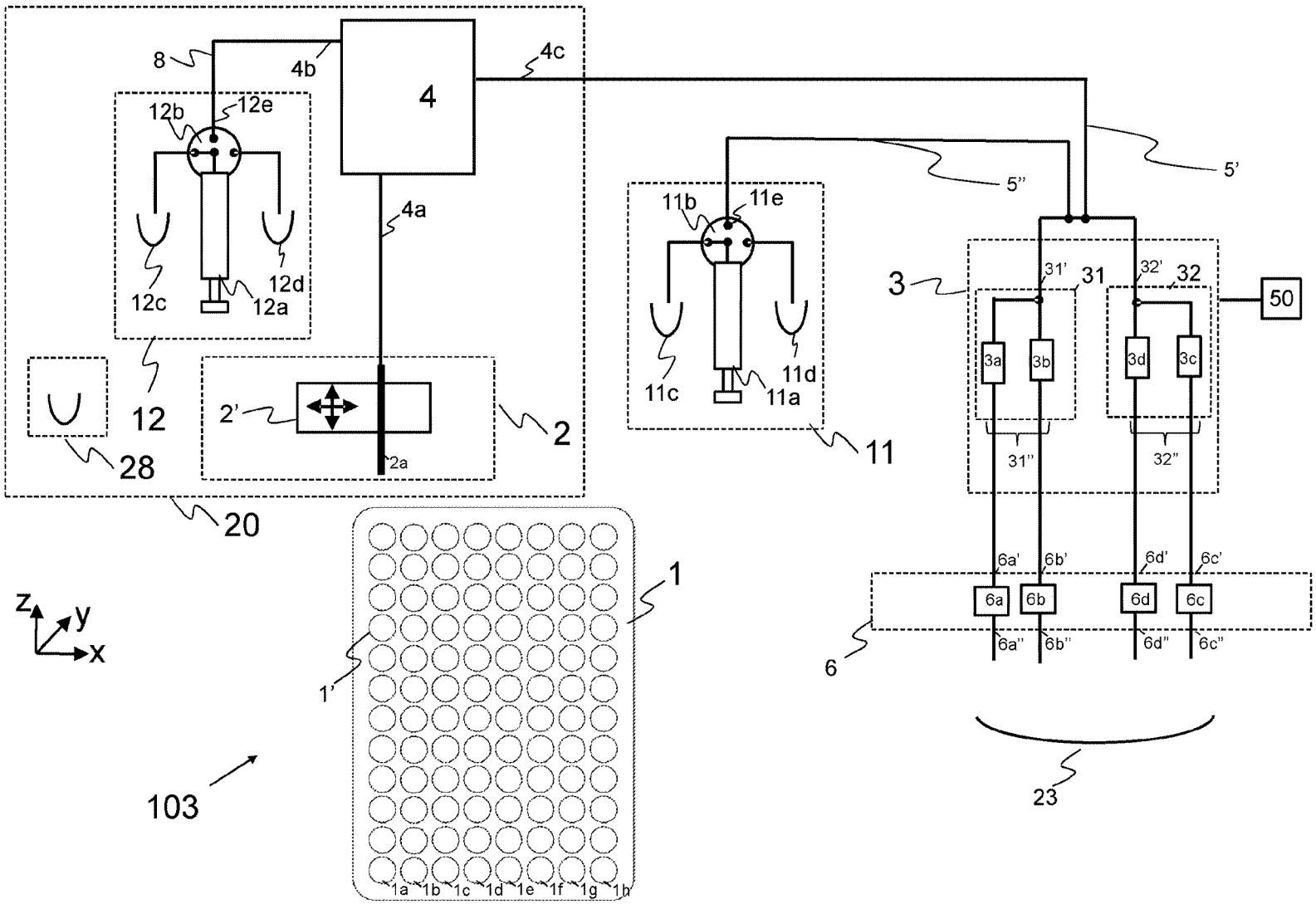
FIG. 3 provides a schematic view of a fluidic assembly according to another embodiment of the present invention.

FIG. 3 provides a schematic view of a fluidic assembly 102 according to another embodiment of the present invention, which is suitable for biochemical sensing (e.g. high throughput biochemical sensing). The fluidic assembly 102 has many of the same features as the fluidic assembly 100 shown in FIG. 1, and like features are awarded the same reference numbers.

In the fluidic assembly 102, the flow cells 3*a,b* and 3*c,d* in each flow cell group 31,32, in the flow cell unit 3, are arranged in parallel within that group (instead of being arranged in series as is the case in assemblies 100,101 of FIGS. 1 and 2). Thus, in this example, the first flow cell group 31 comprises a first flow cell 3*a* and a second flow cell 3*b* which are arranged in parallel (i.e. the inputs of the first flow cell 3*a* and the second flow cell 3*b* are each fluidly connected to the input port 31' of the first flow cell group 31); the second flow cell group 31 comprises a third flow cell 3*c* and a fourth flow cell 3*d* which are arranged in parallel (i.e. the inputs of the third flow cell 3*c* and the fourth flow cell 3*d* are each fluidly connected to the input port 32' of the second flow cell group 32).

In the fluidic assembly 102, the group selector valve unit 6 comprises additional valves which allow to 'select' (address) the flow cells 3*a*,3*b*,3*c*,3*d*, individually, within each flow cell group 31,32. In the fluidic assembly 102, the group selector valve unit 6 comprises a first group selector valve 6*b*, a second selector valve 6*d*, a third group selector valve 6*a*, and a fourth group selector valve 6*c*. The first group selector valve 6*b* has an input 6*b*' and an output 6*b*"; the second selector valve 6*d* has an input 6*d*' and an output 6*b*"; the third group selector valve 6*a* has an input 6*a*' and an output 6*a*"; and the fourth group selector valve 6*c* has an input 6*c*' and an output 6*c*".

The input 6*b*' of the first group selector valve 6*b* is fluidly connected to the second flow cell 3*b* and the output 6*b*" of the first group selector valve 6*b* is fluidly connected to the waste container 23. The input 6*d*' of the second group selector valve 6*d* is fluidly connected to the fourth flow cell 3*d* and the output 6" of the second group selector valve 6*d* on is fluidly connected to the waste container 23. The input 6*a*' of the third group selector valve 6*a* is fluidly connected to the first cell 3*a* and the output 6*a*" of the third group selector valve 6*a* is fluidly connected to the waste container 23. The input 6*c*' of the fourth group selector valve 6*c* is fluidly connected to the third flow cell 3*c* and the output 6" of the second group selector valve 6*d* on is fluidly connected to the waste container 23. third selector valve 6*a* fourth selector valve 6*c*.

The group selector valve unit 6 can be selectively arranged to have a first configuration, second configuration, third configuration fourth configuration, fifth configuration, or sixth configuration:

When the group selector valve unit 6 is in its first configuration, the first group selector valve 6*b* and the third selector valve 6*a* are in their open state, while the second group selector valve 6*d* and the fourth selector valve 6*c* are in their closed state. In the first configuration the first flow cell group 31 is 'selected' (or 'addressed).

When the group selector valve unit is in its second configuration, the first group selector valve 6*b* and the third selector valve 6*a* are in their closed state, while the second group selector valve 6*d* and the fourth selector valve 6*c* are in their open state. In the second configuration the second flow cell group 32 is 'selected' (or 'addressed).

As mentioned the group selector valve unit 6 can be furthermore selectively arranged into a third, fourth, fifth or sixth configuration; the third, fourth, fifth or sixth configuration allow fluid passage through individual flow cells. In particular, when the group selector valve unit 6 is in its third configuration, the third selector valve 6*a* is in its open state, while the first group selector valve 6*b* and the second group selector valve 6*d* and the fourth selector valve 6*c* are in their closed state.

When the group selector valve unit 6 is in its fourth configuration, the first group selector valve 6*b* is in its open state, while the third selector valve 6*a* and the second group selector valve 6*d* and the fourth selector valve 6*c* are in their closed state.

When the group selector valve unit 6 is in its fifth configuration, the fourth selector valve 6*c* is in its open state, while the third selector valve 6*a* and the first group selector valve 6*b* and the second group selector valve 6*d* are in their closed state When the group selector valve unit 6 is in its sixth configuration, the second group selector valve 6*d* is in its open state, while the third selector valve 6*a* and the first group selector valve 6*b* and the fourth selector valve 6*c* are in their closed state.

In the depicted embodiment, in order to allow fluid to flow through the first flow cell 3*a* only and not through the other flow cells 3*b*,3*c*,3*d* in the flow cell unit 3 (in other word in order to 'select' (or address) the first flow cell 3*a* only), the group selector valve unit 6 is arranged into its third configuration. In order to allow fluid to flow through the second flow cell 3*b* only and not through the other flow cells 3*a*,3*c*,3*d* in the flow cell unit 3 (in other words in order to 'select' (or address) the second flow cell 3*b* only), the group selector valve unit 6 is arranged into its fourth configuration. In order to allow fluid to flow through the third flow cell 3*c* only and not through the other flow cells 3*a*,3*b*,3*d* in the flow cell unit 3 (in other words in order to 'select' (or address) the third flow cell 3*c* only), the group selector valve unit 6 is arranged into its fifth configuration. And in order to allow fluid to flow through the fourth flow cell 3*d* only and not through the other flow cells 3*a*,3*b*,3*c*, (in other word in order to 'select' (or address) the fourth flow cell 3*a* only) the group selector valve unit 6 is arranged into its sixth configuration. In the assembly 102 of FIG. 3, advantageously the flow cells 3*a-d* in the flow cell unit 3 can be individually addressed, and in particular the flow cells 3*a-d* belonging to the same flow cell group can be individually addressed; this enables ligands to be supplied to each individual flow cell; this means that different type of ligands can supplied to the individual flow cells belonging to the same flow cell group, and thus different types of ligands can be immobilized on the test surfaces of the flow cells in the same group.

Finally, in order to allow fluid to flow through both the third flow cell 3*c* and fourth flow cell 3*d* and not through the other flow cells 3*a,b* in the flow cell unit 3 (in other words in order to 'select' (or address) the third flow cell 3*c* and fourth flow cell 3*d* i.e. in order to 'select' (or address) the second group of flow cells 32), the group selector valve unit 6 is arranged into its second configuration. In order to allow fluid to flow through both the first flow cell 3*a* and second flow cell 3*b* and not through the other flow cells 3*c,d* in the flow cell unit 3 (in other words in order to 'select' (or address) the first flow cell 3*a* and second flow cell 3*b* i.e. in order to 'select' (or address) the first group of flow cells 31), the group selector valve unit 6 is arranged into its first configuration.

Thus, in the assembly 102 of FIG. 3, to order to 'select' (or 'address') the first flow cell group 31 the group selector valve unit 6 is arranged into its first configuration. In order to 'select' (or 'address') the second flow cell group 32 the group selector valve unit 6 is arranged into its second position.

In the assemblies 100,101, 102 depicted in FIG. 1, FIG. 2 and FIG. 3, it should be noted that all conduits can be made of tubings, such as PEEK or PFA or stainless steel tubings.

Figure 4:
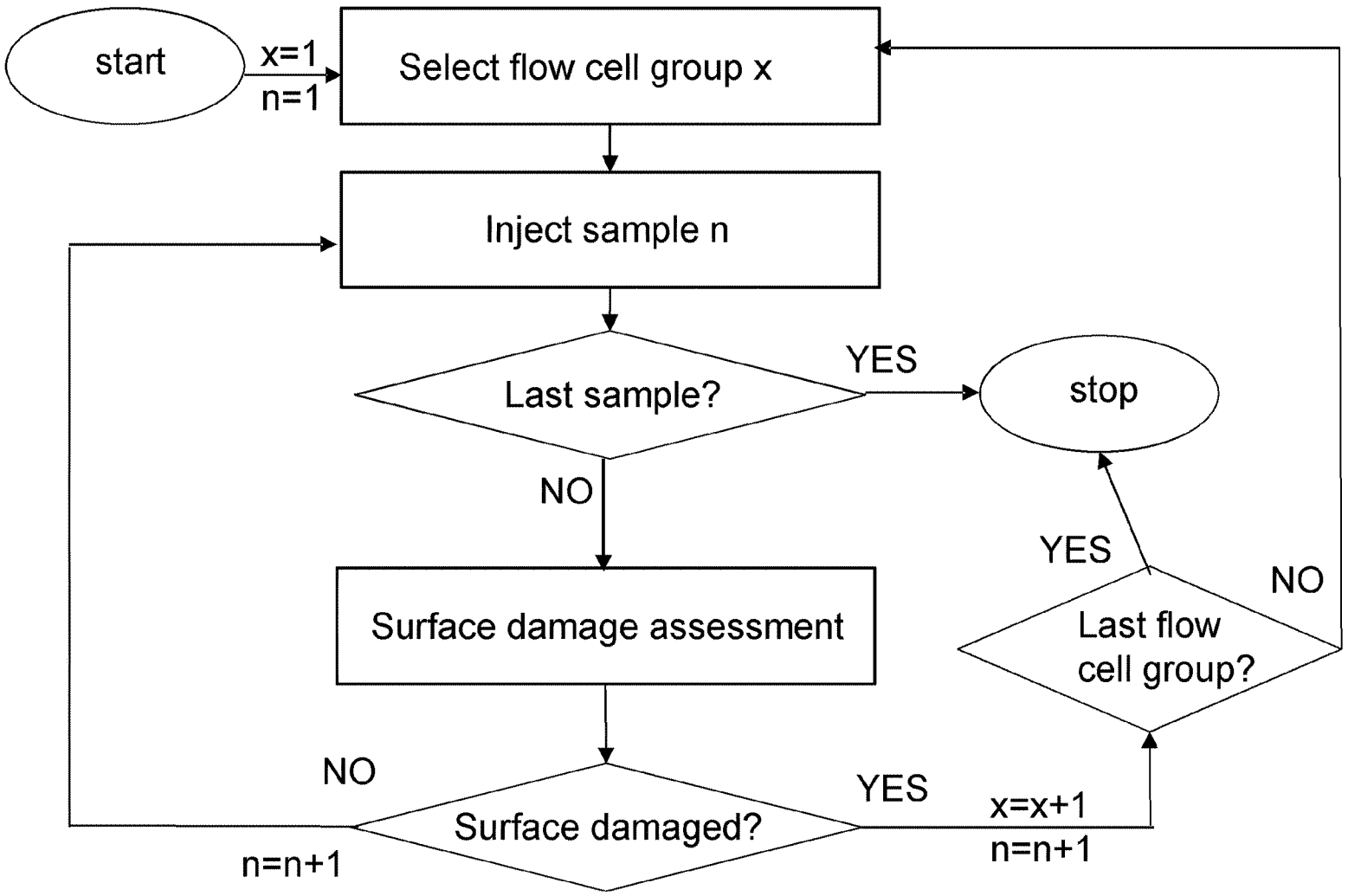
FIG. 4 is a flow chart illustrating the steps of a method of screening samples, according to an embodiment of the present invention.

FIG. 4 is a flow chart showing the step performed in a method for screening a plurality of samples, according to an embodiment of the present invention. Specifically, the method is for screening a plurality of samples for binding to ligands on the test surface of the flow cells in the flow cell unit 3, according to an embodiment of the present invention. Any of the above-mentioned assemblies 100, 101, 102 can be used to implement the method. It should be understood that any assembly, which comprises a plurality of groups of flow cells (each group having two or more flow cell), and wherein the assembly can be configured so that each group of flow cells can been individually selected (or addressed), could be used to implement the method. For example any assembly, which comprises a plurality of groups of flow cells (each group having two or more flow cell), and wherein the assembly comprises a group selector valve which can be selectively configured so that each group of flow cells can been individually selected (or addressed), could be used to implement the method.

As shown in FIG. 4 the method comprises the steps of:

Step (a), Selecting a flow cell group (e.g. selecting the first flow cell group 31). In the description of the assemblies 100, 101,102 it has been detailed how one configures the assembly to 'select' (or 'address') a group (for example the above description of the assemblies 100, 101,102 describes how to 'select' (or 'address') the first flow cell group 31). Then, a "baseline step" is carried out (the baseline step is for equilibrating the flow cells within the selected flow cell group, and for referencing purposes). The baseline step comprises passing buffer fluid through the flow cells within the selected group, signals which are output from the sensor 50 are recorded as the buffer fluid passed through all of the flow cells belonging to the selected group. There will be a signal for each flow cell in the group, each signal defines a baseline signal for the corresponding flow cell. The 'start' of a baseline step is defined as when buffer fluid first begins to flow through the flow cell in the selected group (and/or is defined as when a pumping means (e.g. pumping means 11) which is selectively operable to pump buffer fluid into the flow cells of a selected group, is configured to provide positive pressure at its output (e.g. output 11*e*)); the 'end' of a baseline step is defined by time instant which occurs at a predefined time period (for example one seconds, two seconds, five seconds, ten seconds, twenty seconds or thirty seconds) after the 'start' of the baseline step (or is defined as when the buffer fluid stops flowing through the flow cells of the selected group (the buffer fluid may still be present in said flow cells, but just does not flow); or is defined as when a pumping means (e.g. pumping means 11) which is selectively operable to pump buffer fluid into the flow cells of a selected group, is configured to stop providing positive pressure at its output (e.g. output 11*e*).

Step (b), defines an "injection step"; to carry out the injection step the sample fluid is injected into the selected flow cell group. In other words sample fluid is passed through all of the flow cells belonging to the selected group. Signals which are output from the sensor 50 are recorded as the sample fluid passed through all of the flow cells belonging to the selected group; there will be a signal for each flow cell in the group, each signal represents the binding of molecules in the sample fluid to the ligands on the test surface of that flow cell, and/or represents dissociation of molecules which were bound to the ligands on the test surface of that flow cell. The 'start' of a sample injection step is defined as when the sample fluid which is injected first contacts the test surface of a flow cell in the selected group; the 'end' of a sample injection step is defined by a time instant which occurs a predefined time period (for example one seconds, two seconds, five seconds, ten seconds, twenty seconds or thirty seconds) after the 'start' of the injection step (or is defined as when the sample fluid which has been injected stops flowing through the flow cells of the selected group (the sample may still be present in said flow cells, but it just does not flow).

Optionally, a "dissociation step" is then carried out. The "dissociation step" comprises recording the signals which are output from the sensor 50 from the time instant which defines the end of the "injection step" up until the rate dissociation (i.e. the rate at which molecules which are dissociating from the ligands on the test surface(s) of the flow cells in the selected group) has reduced to a predefined threshold rate. The 'start' of a dissociation step is defined as when buffer fluid first begins to flow through the flow cell in the selected group after the injection step has been carried out (and/or is defined as when a pumping means (e.g. pumping means 11) which is selectively operable to pump buffer fluid into the flow cells of a selected group, is configured to provide positive pressure at its output (e.g. output 11*e*) after the injection step has been carried out); the 'end' of a dissociation step is defined by time instant which occurs a predefined time period (for example one seconds, two seconds, five seconds, ten seconds, twenty seconds or thirty seconds) after the 'start' of the dissociation step (or is defined as when the buffer fluid stops flowing through the flow cells of the selected group, after the injection step has been carried out (the buffer fluid may still be present in said flow cells, but just does not flow); or is defined as when the when a pumping means (e.g. pumping means 11) which is selectively operable to pump buffer fluid into the flow cells of a selected group, is configured to stop providing positive pressure at its output (e.g. output 11*e*) after the injection step has been carried out) It should be understood that the buffer fluid may be a dissociation agent, which promotes the dissociation of bound molecules from the ligands within the flow cells of the selected flow cell group.

Step (c), Then a damage assessment step is carried out to determine if the test surface of a flow cell in the selected group has been damaged (in particular to determine if the test surface of a flow cell in the selected group has been damaged by the sample fluid which last passed through the flow cell). More details of how the damage assessment step can be carried out will be provided below.

If it is determined that the test surface of a flow cell in the selected group has not been damaged then the above mentioned steps (b) and (c) are repeated for the next sample. Indeed the above mentioned steps (b) and (c) are repeated for the next sample until, either all the sample fluids have been screened, or until the damage assessment step indicates that the test surface of a flow cell in the selected group has been damaged.

If it is determined that the test surface of a flow cell in the selected group has been damaged then, Step (d), Another flow cell group is selected (e.g. the second flow cell group 32 is selected) is carried out. In the description of the assemblies 100, 101,102 it has been detailed how one configures the assembly to 'select' (or 'address') a group (for example the above description of the assemblies 100, 101, 102 describes how to 'select' (or 'address') the second flow cell group 32). Then, a "baseline step" is carried out (the baseline step is for equilibrating the flow cells within the selected flow cell group). The baseline step comprises passing buffer fluid through the flow cells within the selected other group, signals which are output from the sensor 50 are recorded as the buffer fluid passed through all of the flow cells belonging to the selected other group. There will be a signal for each flow cell in the selected other group, each signal defines a baseline signal for the corresponding flow cell.

Step (e), defines another "injection step"; to carry out the injection step the next sample fluid is injected into said now selected, other, flow cell group (e.g. the second flow cell group 32). In other words sample fluid is passed through all of the flow cells belonging to said now selected, other, flow cell group. The signals which are output from the sensor 50 are recorded as the sample fluid passed though all of the flow cells belonging to said now selected, other, flow cell group; there will be a signal for each flow cell in the group, each signal represents the binding of molecules in the sample fluid to the ligands on the test surface of that flow cell, and/or represents dissociation of molecules which were bound to the ligands on the test surface of that flow cell. Optionally, a "dissociation step" is then carried out. The "dissociation step" comprises recording the signals which are output from the sensor 50 from the time instant which defines the end of the "injection step" up until the rate dissociation (i.e. the rate at which molecules which are dissociating from the ligands on the test surface(s) of the flow cells in the selected group) has reduced to a predefined threshold rate. The start of the "dissociation step" is defined by the end of the "injection step" and the end of the dissociation step is defined as the time instant when the rate dissociation has reduced to a predefined threshold rate. In a variation the "dissociation step" may further comprise injecting a dissociation agent into the flow cells of the selected flow cell, which promotes the dissociation of bound molecules from the ligands within the flow cells of the selected flow cell group.

Step (f), Then a damage assessment step is carried out to determine if the test surface of said now selected, other, flow cell group (e.g. the second flow cell group 32), has been damaged (in particular to determine if the test surface of a flow cell in the group has been damaged by the sample fluid which last passed through the flow cell). More details of how the damage assessment steps can be carried out will be provided below.

If it is determined that the test surface of a flow cell in said now selected, other, flow cell group (e.g. the second flow cell group 32) has not been damaged, then the above mentioned steps (e) and (f) are repeated for the next sample. Indeed the above mentioned steps (e) and (f) are repeated for the next sample until, either, all the sample fluids have been screened, or until the damage assessment step indicates that test surface of a flow cell in said now selected, other, flow cell group (e.g. the second flow cell group 32) has been damaged.

Most preferably, if it is determined that the test surface of a flow cell in said now selected, other, flow cell group (e.g. the second flow cell group 32) has been damaged, and there are still remaining sample fluids to be screened, and there is no other flow cell groups available in the assembly, then the test surfaces in each of the flow cell groups in the assembly are replaced with new test surfaces; and the above mentioned steps are repeated to screen the remaining sample fluids. It is understood that replacing the test surfaces in each of the flow cell groups can be either a manual process such as manually replacing a sensor chip, or automated such as automatically replacing a sensor chip. It is also understood that replacing the test surfaces in each of the flow cell groups in the assembly can involve only replacing said test surfaces, such as in an assembly where a chip with test surfaces thereon is docked to a unit with solid support having recesses in form of channels formed therein, thus forming the flow cells upon docking; or replacing the test surfaces in each of the flow cell groups in the assembly can involve replacing the whole flow cells, such as in an assembly where the flow cells and the chip with test surfaces are built into a cartridge which can be removably attached to the assembly.

Of course it should be noted that if there are more flow cell groups available in the assembly, then these flow cell groups can be selected (addressed) and used to screen any remaining sample fluids; in other words the flow cells in each of the flow cell groups in the assembly need only to be replaced with new flow cells, only when there are still remaining sample fluids to be screened, and there is no other flow cell groups (which do not have flow cells with damaged test surfaces) available in the assembly which could be selected (addressed).

Importantly, in the above-mentioned assemblies 100,101, 102, most preferably, in each flow cell group 31,32, one of the flow cells, referred to hereafter as the active flow cell, in said group has a test surface having ligands which can bind to molecules of a sample fluid, and the other flow cell, referred to hereafter as reference flow cell, in the group is a reference flow cell which has no ligands on its test surface or has reference ligands on its test surface. As already mentioned above, in this application, in each and every embodiment, each flow cell group 31,32 comprises, at least one flow cell which has a first type of ligands which could potentially bind to molecules of a sample fluid (the purpose of the screening is to determine if these first type of ligands do bind to molecules which are, a priori, known to be present in the samples which are to be screened); and at least another flow cell which serves as a reference flow cell. The reference flow cell either has no ligands on its test surface, or has reference ligands bound to its test surface, wherein reference ligands are second type of ligand which are different to the first type of ligand. In this application the reference ligand is defined as being a second type of ligand which is different to the first type of ligand.

A mentioned above a sensor (50) signal is recorded during a baseline step and dissociation step; each the recorded sensor signal represents the binding, and/or dissociation, of molecules from ligands on the test surface of that flow cell; of course if there is no ligands on the test surface of a flow cell (such as can be the case for the reference flow cell) then the recorded signal taken for that flow cell will indicate no binding to ligands and/or dissociation from ligands, it may however indicate some binding of molecules directly to the test surface. The sensor signal which is recorded from the reference flow cell is subtracted from the sensor signal which is recorded from the reference flow cell, to provide a modified recorded sensor signal.

Optionally, in another embodiment prior to carrying out the baseline step and dissociation step, a buffer fluid may be passed through the active flow cell and a sensor signal is recorded as the buffer fluid passes through the active flow cell; said sensor signal is recorded as the buffer fluid passes through the active flow cell is referred to hereafter as the background signal. In one embodiment, the background signal is subtracted from the sensor signal which is recorded from the reference flow cell to provide a modified reference flow cell signal, the background signal is subtracted from the sensor signal which is recorded from the reference flow cell to provide a modified sensor signal; the modified reference flow cell signal is subtracted from the modified sensor signal, to provide said modified recorded sensor signal.

Most preferably, the surface damage assessment step comprises evaluating said modified recorded sensor signal.

It is understood that preferably the dissociation step which is carried out for the last sample to have been injected defines the baseline step which is carried out for the next sample fluid to be injected. In other words the dissociation step carried out for one sample defines the baseline step for the next sample (e.g. after the baseline step has been carried out for the first sample, and the first sample has been injected, the dissociation step for that first sample defines the baseline step for the next, second, sample to be injected). In other words, after the first sample has been injected, the dissociation steps and baselines steps carried out for each of the remaining samples which are injected are defined by the same single step.

In a first embodiment, evaluating said modified recorded sensor signal comprises, calculating the average (R(tb)) of the modified recorded sensor signal at at least at one point in time (tb) which is during the time period when the baseline step was being carried out, and calculating the average (R(td)) of the modified recorded sensor signal at at least at one point in time (td) which is during the time period when the dissociation step was being carried out.

The "average" of the modified recorded sensor signal, at any particular point in time (e.g tb, td), is the sum of each of the points in the modified recorded sensor signal, over a predefined section of the modified recorded sensor signal which is centred around said point in time (e.g tb, td). For example the average (R(tb)) of the modified recorded sensor signal at a point in time 'tb' (which is a point in time during the baseline step) is, for example the addition of each of the ten points of modified recorded sensor signal which immediately precede time 'tb' plus the addition of each of the ten points of modified recorded sensor signal immediately after time 'tb', divided by '21' (i.e. '21' points on the modified recorded sensor signal). It should be noted that the predefined section of the modified recorded sensor signal over which the average is taken can be any size. Most preferably the average (R(tb)) of the modified recorded sensor signal at time tb during the baseline step, is an average of a section of the modified recorded sensor signal centered at time tb, said section of the modified recorded sensor signal having a duration of 0.1 seconds, or 0.2 seconds, or 0.5 seconds, or one second, or two seconds, or three seconds or five seconds. Preferably the average (R(td)) of the modified recorded sensor signal at the point in time td during the dissociation step is an average of a section of the modified recorded sensor signal centered at time td, said section of the modified recorded sensor having a duration of 0.1 seconds, or 0.2 seconds, or 0.5 seconds, or one second, or two seconds, or three seconds or five seconds.

In a preferred embodiment, the point in time tb which is during the time period when the baseline was being carried out, is 0.1 seconds before the end of the baseline step, or 0.2 seconds before the end of the baseline step, or 0.5 or seconds before the end of the baseline step, one second before the end of the baseline step, or two seconds before the end of the baseline step, or three seconds before the end of the baseline step, or five seconds before the end of the baseline step; the point in time td which is during the time period when the dissociation step was being carried out, is 0.1 seconds before the end of the dissociation step, or 0.2 seconds before the end of the dissociation step, or 0.5 or seconds before the end of the dissociation step, one second before the end of the dissociation step, or two seconds before the end of the dissociation step, or three seconds before the end of dissociation step, or five seconds before the end of the dissociation step.

Then, said calculated averages (R(tb), R(td)) are compared to a predefined model and the comparison is used to determine if the last sample which was injected into the flow cell group has damaged the test surface of the active flow cell in group. In the preferred embodiment, the step of comparing said calculated averages to a predefined model, and using the comparison to determine if the last sample which was injected into the flow cell group has damaged the test surface of the active flow cell in that group, comprises, comparing the difference between the average (R(td)) of the modified recorded sensor signal at time td during the dissociation step and the average (R(tb)) of the modified recorded sensor signal at time tb during the baseline step, to a predefined threshold average value (R1):

$$R(td)-R(tb)>R1$$

Wherein R(td) is the average of the modified recorded sensor signal at a time td during the dissociation step and R(tb) is the average of the modified recorded sensor signal at a time tb during the baseline step, and R1 is the threshold average value.

If the difference between the average (R(td)) of the modified recorded sensor signal at time td and the average (R(tb)) of the modified recorded sensor signal at a time tb, is greater than the threshold average value R1, then it is determined that the test surface of the active flow cell in the flow cell group (i.e. the active flow cell in the flow cell group through which the last sample was passed) has been damaged. For example, if the difference between R(td) and R(tb) is greater than the threshold average value R1, then this would indicate that the recorded signal for the active flow cell, did not return to baseline, indicating that molecules from the sample fluid are bound too tightly to the ligands on the test surface of the active flow sell). If the difference between the average (R(td)) of the recorded sensor signals at a time (td) during the dissociation step and the average (R(tb)) of the recorded sensor signals at a time (tb) during the baseline step, is less than the threshold average value R1, then it is determined that the test surface of the active flow cell in the flow cell group (i.e. the active flow cell in the flow cell group through which the last sample was passed) has not been damaged. Preferably, the threshold average R1 is selected by analysing historical data sets representing binding of known behaviour, more specifically comparing R'=R(td)−R(tb) obtained for molecules which did not damage test surfaces to R"=R(td)−R(tb) for molecules which damaged test surfaces, and choosing R'<R1<R" accordingly. For example, R1 could be selected by: determining R' (wherein R'=R(td)−R(tb)) for each of plurality of samples (i.e. past samples) which did not damage test surface(s) of the flow cell(s) in a flow cell group, when they flowed through said flow cells of said flow cell group; determining R" (wherein R"=R(td)−R(tb)) for each of plurality of samples (i.e past samples) which did damage the test surface(s) of the flow cell(s) in said flow cell group, when they flowed through said flow cells of said flow cell group; and selecting a value for R1 which is between the R' and R" values. For example, the values of R' and R" of each sample could be plotted—the resulting plot will result in a first peak (which is results from the R' values) and a second peak (which results from R" values), then R1 is selected as a value which is between the first and second peak. Preferably, the threshold average R1 is selected by taking into consideration the noise or detection limit of sensor 50 by choosing a value for the threshold average R1 which is above at least three times or five times or ten times the standard deviation of the noise or detection limit of sensor 50.

In a second embodiment, evaluating said modified recorded sensor signal comprises, calculating the average (R(tb)) of the modified recorded sensor signal at at least at one point in time (tb) which is during the time period when the baseline step was being carried out, and calculating the average (R(td)) of the modified recorded sensor signal at at least at one point in time (td) which is during the time period when the dissociation step was being carried out; and further calculating the slope M(td') of the modified recorded sensor signal at at least at one point in time (td') which is during the time period when the dissociation step was being carried out. It should be noted that the point in time td' where the slope of the modified recorded sensor signal is calculated could be equal to, or, could be different to, the point in time td where the average of the modified recorded sensor signal is calculated; however both td' and td are points in time which are during the time period when the dissociation step was being carried out.

As already mentioned "average" of the modified recorded sensor signal, at any particular point in time (e.g tb, td), is the average of each of the points in the modified recorded sensor signal, over a predefined section of the modified recorded sensor signal which is centred around said point in time (e.g tb, td), (determined for example by the sum of each of the points in the modified recorded sensor signal over the predefined section divided by the number of the points. Most preferably the average (R(tb)) of the modified recorded sensor signal at time tb during the baseline step, is an average of a section of the modified recorded sensor signal centered at time tb, said section of the modified recorded sensor having a duration of 0.1 seconds, or 0.2 seconds, or 0.5 seconds, or one second, or two seconds, or three seconds or five seconds. Preferably the average (R(td)) of the modified recorded sensor signal at the point in time td during the dissociation step is an average of a section of the modified recorded sensor signal centered at time td, said section of the modified recorded sensor having a duration of 0.1 seconds, or 0.2 seconds, or 0.5 seconds, or one second, or two seconds, or three seconds or five seconds.

The slope M(td') of the modified recorded sensor signal, at any particular point in time (e.g td'), is the slope of a section of the modified recorded sensor signal centered at that point in time. So the slope M(td') of the modified recorded sensor signal, at any the point in time td' during the dissociation step, is the slope of a section of the modified recorded sensor signal centered at the time td'. Said section of the modified recorded sensor preferably has a duration of 0.1 seconds, or 0.2 seconds, or 0.5 seconds, or one second, or two seconds, or three seconds or five seconds.

In a preferred embodiment, the point in time tb which is during the time period when the baseline was being carried out, is 0.1 seconds before the end of the baseline step, or 0.2 seconds before the end of the baseline step, or 0.5 or seconds before the end of the baseline step, one second before the end of the baseline step, or two seconds before the end of the baseline step, or three seconds before the end of the baseline step, or five seconds before the end of the baseline step; the point in time td which is during the time period when the dissociation step was being carried out, is 0.1 seconds before the end of the dissociation step, or 0.2 seconds before the end of the dissociation step, or 0.5 or seconds before the end of the dissociation step, one second before the end of the dissociation step, or two seconds before the end of the dissociation step, or three seconds before the end of dissociation step, or five seconds before the end of the dissociation step.

Then, said calculated averages (R(tb), R(td)) and said calculated slope M(td') are each compared to a predefined model and the comparison is used to determined if the last sample which was injected into the flow cell group has damaged the test surface of the active flow cell in group. In the preferred embodiment, the step of comparing said calculated averages (R(tb), R(td)) and said calculated slope M(td') to a predefined model, and using the comparison to determine if the last sample which was injected into the flow cell group has damaged the test surface of the active flow cell in that group, comprises:

Comparing the difference between the average (R(td)) of the modified recorded sensor signal at time td during the dissociation step and the average (R(tb)) of the modified recorded sensor signal at time tb during the baseline step, to a predefined threshold average value (R1):

$$R(td)-R(tb)>R1$$

Wherein R(td) is the average of the modified recorded sensor signal at a time td during the dissociation step and R(tb) is the average of the modified recorded sensor signal at a time tb during the baseline step, and R1 is the threshold average value, and comparing the said calculated slope M(td') to a threshold slope value M1:

$$M(td')>M1$$

Wherein M(td') is the slope of the modified recorded sensor signal at a time td' during the dissociation step and M1 is a threshold slope value.

Preferably, the threshold average R1 and the threshold slope value M1 are selected by analysing historical data sets representing binding of known behaviour, more specifically by: determining R' (wherein R'=R(td)−R(tb)) for each of plurality of samples (i.e. past samples) which did not damage test surface(s) of the flow cell(s) in a flow cell group, when they flowed through said flow cells of said flow cell group; determining R" (wherein R"=R(td)−R(tb)) for each of plurality of samples (i.e. past samples) which did damage the test surface(s) of the flow cell(s) in said flow cell group, when they flowed through said flow cells of said flow cell group; and selecting a value for R1 which is between the R' and R" values. For example, the values of R' and R" of each sample could be plotted—the resulting plot will result in a first peak (which is results from the R' values) and a second peak (which results from R" values), then R1 is selected as a value which is between the first and second peak. Similarly, in order to determine M1, one may carry out the steps of: determining M'=M(td'), for each of plurality of samples (i.e. past samples) which did not damage test surface(s) of the flow cell(s) in a flow cell group, when they flowed through said flow cells of said flow cell group; and determining M"=M(td") for each of plurality of samples (i.e. past samples) which did damage the test surface(s) of the flow cell(s) in said flow cell group, when they flowed through said flow cells of said flow cell group; and selecting a value for M1 which is between the M' and M" values. For example, the values of R' and R", and the values of M' and M" could be plotted on a scatter plot—the resulting plot will result in a first cluster (which is results from the R' values and M' values) and a second cluster (which results from R" values and M" values); R1 and M1 are selected so that they lie on a line which lies between the first and second clusters. In other words the threshold average R1 and the threshold slope value M1 are selected such as it can be expected that the population (R', M') of molecules which did not damage test surfaces can be reasonably well separated from the population (R", M") of molecules which did damage test surfaces. Preferably, the threshold average R1 is selected by taking into consideration the noise of sensor 50 by choosing a value for the threshold average R1 which is above at least three times or five times or ten times the standard deviation of the noise or detection limit of sensor 50.

If the difference between the average (R(td)) of the modified recorded sensor signal at time td and the average (R(tb)) of the modified recorded sensor signal at a time tb, is greater than the threshold value R1, and if the slope (M(td')) of the modified recorded sensor signal at a time td is greater than the threshold slope value M1, then it is determined that the test surface of the active flow cell in the flow cell group (i.e. the active flow cell in the flow cell group through which the last sample was passed) has been damaged (since such would indicate that the recorded signal for the active flow cell, did not return to baseline, indicating that molecules from the sample fluid are bound too tightly to the ligands on the test surface of the active flow cell).

If the difference between the average (R(td)) of the recorded sensor signals at a time (td) during the dissociation step and the average (R(tb)) of the recorded sensor signals at a time (tb) during the baseline step, is less than the threshold value R1, and/or if the slope (M(td')) of the modified recorded sensor signal at a time td is less than the threshold slope value M1, then it is determined that the test surface of the active flow cell in the flow cell group (i.e. the active flow cell in the flow cell group through which the last sample was passed) has not been damaged.

In a third embodiment, evaluating said modified recorded sensor signal comprises, calculating the average (R(tb)) of the modified recorded sensor signal at at least at one point in time (tb) which is during the time period when the baseline step was being carried out, and calculating the average (R(td)) of the modified recorded sensor signal at at least at one point in time (td) which is during the time period when the dissociation step was being carried out, and calculating the average (R(ti)) of the modified recorded sensor signal at at least at one point in time (ti) which is during the time period when the injection step was being carried out.

As mentioned the "average" of the modified recorded sensor signal, at any particular point in time (e.g tb, td, ti), is the sum of each of the points in the modified recorded sensor signal, over a predefined section of the modified recorded sensor signal which is centred around said point in time (e.g tb, td, ti). It should be noted that the predefined section of the modified recorded sensor signal over which the average is taken can be any size. Preferably the average (R(tb)) of the modified recorded sensor signal at time tb during the time period when the baseline step was being carried out, is an average of a section of the modified recorded sensor signal centered at time tb, said section of the modified recorded sensor having a duration of 0.1 seconds, or 0.2 seconds, or 0.5 seconds, or one second, or two seconds, or three seconds or five seconds. Preferably the average (R(td)) of the modified recorded sensor signal at the point in time td during the time period when the dissociation step was being carried out, is an average of a section of the modified recorded sensor signal centered at time td, said section of the modified recorded sensor having a duration of 0.1 seconds, or 0.2 seconds, or 0.5 seconds, or one second, or two seconds, or three seconds or five seconds. Preferably the average (R(ti)) of the modified recorded sensor signal at time ti during the time period when the injection step was being carried out, is an average of a section of the modified recorded sensor signal centered at time ti, said section of the modified recorded sensor having a duration of 0.1 seconds, or 0.2 seconds, or 0.5 seconds, or one second, or two seconds, or three seconds or five seconds.

In the preferred embodiment, the point in time tb which is during the time period when the baseline was being carried out, is 0.1 seconds before the end of the baseline step, or 0.2 seconds before the end of the baseline step, or 0.5 or seconds before the end of the baseline step, one second before the end of the baseline step, or two seconds before the end of the baseline step, or three seconds before the end of the baseline step, or five seconds before the end of the baseline step; the point in time td which is during the time period when the dissociation step was being carried out, is 0.1 seconds before the end of the dissociation step, or 0.2 seconds before the end of the dissociation step, or 0.5 or seconds before the end of the dissociation step, one second before the end of the dissociation step, or two seconds before the end of the dissociation step, or three seconds before the end of dissociation step, or five seconds before the end of the dissociation step; the point in time ti which is during the time period when the injection step was being carried out, is 0.1 seconds before the end of the injection step, or 0.2 seconds before the end of the injection step, or 0.5 or seconds before the end of the injection step, one second before the end of the injection step, or two seconds before the end of the injection step, or three seconds before the end of the injection step, or five seconds before the end of the injection step.

Then, said calculated averages (R(tb), R(td), R(ti)) are compared to a predefined model and the comparison is used to determined if the last sample which was injected into the flow cell group has damaged the test surface of the active flow cell in group. In the preferred embodiment, the step of comparing said calculated averages to a predefined model, and using the comparison to determine if the last sample which was injected into the flow cell group has damaged the test surface of the active flow cell in that group, comprises, comparing the difference between the average (R(td)) of the modified recorded sensor signal at time td during the dissociation step and the average (R(tb)) of the modified recorded sensor signal at time tb during the baseline step, to a threshold value R1(R(ti)) which is a function of the average (R(ti)) of the modified recorded sensor signal at time ti during injection step:

$$R(td)-R(tb)>R1(R(ti)$$

Wherein R(td) is the average of the modified recorded sensor signal at a time td during the dissociation step and R(tb) is the average of the modified recorded sensor signal at a time tb during the baseline step, and R1(R(ti) is the threshold value which is a function of the average (R(ti)) of the modified recorded sensor signal at time ti during injection step.

If the difference between the average (R(td)) of the modified recorded sensor signal at time td and the average (R(tb)) of the modified recorded sensor signal at a time tb, is greater than the threshold value R1(R(ti)), then it is determined that the test surface of the active flow cell in the flow cell group (i.e. the active flow cell in the flow cell group through which the last sample was passed) has been damaged. For example, if the difference between R(td) and R(tb) is greater than the threshold value R1(R(ti)), then this would indicate that the recorded signal for the active flow cell, did not return to baseline, indicating that molecules from the sample fluid are bound too tightly to the ligands on the test surface of the active flow sell). If the difference between the average (R(td)) of the modified recorded sensor signal at time td and the average (R(tb)) of the modified recorded sensor signal at a time tb, is less than the threshold value R1(R(ti)), then it is determined that the test surface of the active flow cell in the flow cell group (i.e. the active flow cell in the flow cell group through which the last sample was passed) has not been damaged.

It should be understood that the threshold value (R1(R(ti)) which is a function of the average (R(ti)) of the modified recorded sensor signal at time ti during injection step, could take any suitable form. An example for a threshold value R1(R(ti)) which is a function of the average (R(ti)) of the modified recorded sensor signal at time ti during injection step is $$R1(R(ti))=r\times R(ti),$$

wherein r is a predefined value greater than '0' but less than '1' (in a preferred embodiment, r is equal to 0.01, or 0.02 or 0.05 or 0.1 or 0.2 or 0.5); and R(ti)) is the average of the modified recorded sensor signal at time ti during injection step.

In a fourth embodiment, evaluating said modified recorded sensor signal comprises, calculating the average (R(tb)) of the modified recorded sensor signal at at least at one point in time (tb) which is during the time period when the baseline step was being carried out, and calculating the average (R(ti)) of the modified recorded sensor signal at at least at one point in time (ti) which is during the time period when the injection step was being carried out. Importantly in this fourth embodiment the samples which have been passed through the flow cells in the flow cell group for executing the inventive method are all reference samples (a reference sample is a sample which contain molecules which are a priori known to bind to the ligands which present on the test surface(s) of the flow cell(s) in the selected (i.e. addressed) flow cell group. In a preferred embodiment, the reference samples are injected at a predetermined interval, e.g. such as every eighth sample fluid or every tenth sample fluid or every twelfth sample fluid or every sixteenth sample fluid is a reference sample (the other samples injected being samples which are not reference samples i.e. samples which it is not known if they contain molecules which can bind to the ligands which present on the test surface(s) of the flow cell(s) in the selected (i.e. addressed) flow cell group). Accordingly the steps of this fourth embodiment are then only applied to the recorded sensor signal obtained during the baseline and injection steps of the reference sample (i.e. are only applied at said predetermined interval).

As mentioned the "average" of the modified recorded sensor signal, at any particular point in time (e.g tb, ti), is the sum of each of the points in the modified recorded sensor signal, over a predefined section of the modified recorded sensor signal which is centred around said point in time (e.g tb, td, ti). It should be noted that the predefined section of the modified recorded sensor signal over which the average is taken can be any size. Preferably the average (R(tb)) of the modified recorded sensor signal at time tb during the time period when the baseline step was being carried out, is an average of a section of the modified recorded sensor signal centered at time tb, said section of the modified recorded sensor having a duration of 0.1 seconds, or 0.2 seconds, or 0.5 seconds, or one second, or two seconds, or three seconds or five seconds. Preferably the average (R(ti)) of the modified recorded sensor signal at time ti during the time period when the injection step was being carried out, is an average of a section of the modified recorded sensor signal centered at time ti, said section of the modified recorded sensor having a duration of 0.1 seconds, or 0.2 seconds, or 0.5 seconds, or one second, or two seconds, or three seconds or five seconds.

In the preferred embodiment, the point in time tb which is during the time period when the baseline was being carried out, is 0.1 seconds before the end of the baseline step, or 0.2 seconds before the end of the baseline step, or 0.5 or seconds before the end of the baseline step, one second before the end of the baseline step, or two seconds before the end of the baseline step, or three seconds before the end of the baseline step, or five seconds before the end of the baseline step; the point in time ti which is during the time period when the injection step was being carried out, is 0.1 seconds before the end of the injection step, or 0.2 seconds before the end of the injection step, or 0.5 or seconds before the end of the injection step, one second before the end of the injection step, or two seconds before the end of the injection step, or three seconds before the end of the injection step, or five seconds before the end of the injection step.

Then, said calculated averages (R(tb), R(ti)) are compared to a model (which is preferably has been predetermined) and the comparison is used to determine if one of the previous samples which was injected into the flow cell group has damaged the test surface of the active flow cell in group. In this embodiment said model is a predefined threshold value 'R2'. In one embodiment the predefined threshold value 'R2' can be determined by, before passing sample fluids containing molecules with unknown binding behaviour through the active flow cell, passing one or more reference samples through the active flow cell and recording the signal which is output from the sensor as the reference sample(s) passes through the active flow cell; wherein a reference sample is a sample which is a priori known to have molecules which bind to ligands on the test surface of a flow cell in the selected ('addressed') flow cell group. The signal recorded is referred to hereafter as the reference signal(s). The reference sample(s) comprise molecules which are known to bind to ligands on the test surface of the active flow cell in the flow cell group, and are preferably injected into the active flow cell at regular intervals (such as described in detail in Perspicace et al., J Biomol Screen. 2009 April; 14(4):337-49). A value for the predefined threshold value 'R2' is then selected based on the reference signal(s).

In the preferred embodiment, the step of comparing said calculated averages to the model, and using the comparison to determine if one of the previous samples which was injected into the flow cell group has damaged the test surface of the active flow cell in that group, comprises, comparing the difference between the average (R(ti)) of the modified recorded sensor signal at time ti during the injection step and the average (R(tb)) of the modified recorded sensor signal at time tb during the baseline step, to said threshold value R2 of the reference signal:

$$R(ti)-R(tb)<R2$$

Wherein R(ti) is the average of the modified recorded sensor signal at a time ti during the injection step and R(tb) is the average of the modified recorded sensor signal at a time tb during the baseline step, and R2 is the threshold value of the reference signal. In a preferred embodiment, the threshold value R2 of the reference signal is a fraction of R'(ti)−R'(tb), where R'(ti) is the average of the reference signal at time ti during the injection step and R'(tb) is the average of the reference signal at time tb during the baseline step, such as for instance R2=0.5×R'(ti)−R'(tb), or R2=⅓×R'(ti)−R'(tb), or R2=0.25×R'(ti)−R'(tb), or R2=0.25×R'(ti)−R'(tb). Alternatively, the threshold value R2 can be a predetermined threshold value based on the noise or limit of detection of the sensor 50, such as three times or five times or ten times or twenty times or fifty times or a hundred times the standard deviation of the noise or detection limit of sensor 50.

If the difference between the average (R(ti)) of the modified recorded sensor signal at time ti and the average (R(tb)) of the modified recorded sensor signal at a time tb, is smaller than the threshold value (R2) of the reference signal, then it is determined that the test surface of the active flow cell in the flow cell group (i.e. the active flow cell in the flow cell group through which the last sample was passed) has been damaged. For example, if the difference between R(ti) and R(tb) is smaller than the threshold value (R2) of the reference signal, then this would indicate that the less reference sample molecules have were able to bind to ligands in the active flow cell, indicating that on the ligands on the test surface of the active flow cell have become damaged or biologically inactivated. If the difference between the average (R(ti)) of the modified recorded sensor signal at time ti and the average (R(tb)) of the modified recorded sensor signal at a time tb, is more than the threshold value (R2) of the reference signal, then it is determined that the test surface of the active flow cell in the flow cell group (i.e. the active flow cell in the flow cell group through which the last sample was passed) has not been damaged.

Thus in preferred embodiments of the present invention, the surface damage assessment step comprises analysing the modified recorded sensor signal at a point in time corresponding to when the baseline step was being carried out, and/or a point in time corresponding to when the injection step was being carried out, and/or a point in time corresponding to when the signal he dissociation step was being carried out (the dissociation step may simply be passive wherein simply the injection of sample fluid into the flow cell is stopped, or may be active whereby a fluid (such as a buffer fluid) is injected into the flow cell (in for example a rinsing step) to force any molecules which are bound to ligands in that flow cell to become dissociated), by calculating the averages and/or slopes of the modified recorded sensor at these points in time and comparing the averages and/or slopes to model(s); and using the results of the comparison to determined if the test surface of the flow cell is damaged.

It is understood that any one or more of the above mentioned embodiments of the present invention can be combined in order to achieve an even more robust surface damage assessment. In particular the fourth embodiment involving the evaluation of the signals from sensor 50 recorded during baseline and injection of a reference sample which is known to bind to the ligand, can be combined with any of the first, second or third embodiments involving the evaluation of the signals from sensor 50 recorded during baseline, and injection of a sample molecule for which it is not known if it binds to the ligands.

In further embodiments, other models and methods are implemented to determine if a sample fluid, or more precisely the molecules of the sample fluid which last passed through the active flow cell, has damaged the test surface of that flow cell; in particular models including artificial intelligence or learning networks which are trained by a user may be used.

Advantageously, the methods described above allow to continue screening even in case a problematic sample is injected, which for instance binds irreversibly to a ligand or a surface, or in case a test surface has become damaged due to gradual loss of ligand bioactivity over time.

It should be noted that in the present application damage to a test surface, may include any one or more of (but is not limited to): mechanical damage to the test surface; damage to the ligands; the ligands being biologically inactivated; molecules in sample fluids are irreversibly bound to the test surface; molecules in sample fluids are bound to the walls of flow conduits within the flow cell group and are dissociating from said walls over time; the test surface having molecules from sample fluids permanently bound to the ligands on the test surface (i.e. molecules non dissociating from ligands) (or the test surface having molecules from sample fluids which are dissociating from the ligands on the test surface at a rate which is below a threshold rate (i.e. too slowly dissociating from the ligands on the test surface); mechanical damage to the test surface; above a threshold number of ligands have become detached from the test surface; a hydrogel layer or non-fouling layer has been removed from the test surface or is damaged or is inactivated; any damage to the test surface which causes the sensor readout being in any ways irreversibly perturbed, such as, for instance, an optical readout being attenuated by scattering losses; air bubbles on the test surface or proximate to the test surface (from for, example, air gaps being injected with the molecules in sample fluids and retained on the test surface or its proximity); irreversible or slowly reversible alteration on a hydrogel layer provided on the test surface (caused by for example by the effect of the molecules in sample fluids on the spatial organization of a hydrogel layer; for example hydrogel layer collapse).

Most preferably, prior to the use of any of the assemblies described for screening samples, ligands are first immobilized on the test surfaces of the flow cells which are in the flow cell unit 3. Typically, a number of different types of ligands smaller or equal to the number of flow cells within a flow cell group are immobilized. In particular, for the depicted embodiment, first ligands are immobilized on the test surfaces of the first flow cell 3*a* and the third flow cell 3*c*, and second ligands are immobilized on the test surfaces of the second flow cell 3*b* and the fourth flow cell 3*d*. The first ligands are a different type of ligand to the second ligands. The first ligands and second ligands can bind to molecules which have a predefined characteristic such as having a high affinity to the ligands either via a simple lock-and-key mechanism where a molecule fits into a binding pocket of a ligand, or assisted by more complex molecular processes such as conformational changes (most preferably the first ligands can bind to molecules which have a first predefined characteristic, and the second ligands can bind to molecules which have a second predefined characteristic (the second predefined characteristic being different to the first predefined characteristic). Thus, it can be determined which molecules in a sample fluid have said predefined characteristic of having a high affinity to the ligands, by passing the sample fluid over the test surfaces of flow cells 3*a-d* in the flow cell unit 3 and then determining which molecules have become bound to the ligands on the test surfaces of each respective flow cell 3*a-d*. Typically, the different ligands can be used to exclude non-specific binding effects, for instance by providing the drug target as first ligands, and similar molecules as the drug targets but lacking a specific binding pocket as second ligands. In another example, two different drug targets are provided as first and second ligands. It is understood that a higher number of flow cells per flow cell group allows for determining the molecular binding to a higher number of ligands, in particular an embodiment with four flow cells per flow cell group allows for determining the molecular binding to up to four ligands, and an embodiment with eight flow cells per flow cell group allows for determining the molecular binding to up to eight ligands. It is also understood that surfaces can be left void from any ligand, in particular for referencing purposes to exclude non-specific binding effects related to the surface.

Referring to FIG. 3, during the immobilization step, the ligands and immobilization reagents are provided in the sample container 1.

If the assembly 102 is being use to implement the above mentioned method screening of the preset invention, and the damage assessment step indicates that the test surface of a flow cell in the first group is damaged, then, after the second group 32 has been selected (addressed) but prior to injecting the next sample into the flow cells of the second flow cell group, the method may further comprise an immobilization step which comprises sequentially injecting ligands and immobilization reagents into the flow cells of the second flow cell group 32, in order to selectively immobilize ligands on the test surface of the flow cells in the second flow cell group 32.

Advantageously, in this embodiment, the test surfaces of the flow cells in the second flow cell group 32 are provided with freshly immobilized ligands on their test surface, prior to receiving the sample fluid to be screened.

In a further preferred embodiment, ligands are captured using a capturing approach wherein the ligands can be selectively removed by a regeneration step, and reloaded using re-capturing. Such capturing approaches include but are not limited to capturing ligands to immobilized Protein A or Protein G and regenerating in acidic conditions, or capturing onto Switchavidin (refer to Taskinen et al., Bioconjug Chem. 2014 Dec. 17; 25(12):2233-43 for a detailed description of Switchavidin capturing and regeneration conditions) which has reversibly been captured on immobilized biotin, or methods involving double-stranded DNA coupling and regeneration using Urea, such as used in a CAP chip on Biacore instruments.

It is understood that the procedure described above, where ligands are captured or immobilized onto the test surfaces of other flow cell group(s) (in this example the second flow cell group 32) only as needed, can be implemented using any other fluidic assembly providing a flow cell unit comprising at least two flow cell groups comprising each at least two flow cells, a group selector valve unit for selecting a flow cell group, and secondary selector valves configured to selectively address individual flow cells.

As mentioned any of the above-mentioned assemblies 100, 101, 102 can be used to implement the method. As an example in order to carry out the method illustrated in FIG. 4 using the assembly 100 of FIG. 1, the first flow cell group 31 is selected.

Optionally a baseline step is executed for equilibrating the flow cells within the first flow cell group. In the fluid assembly 100, the baseline step may comprise configuring the second pumping means 11 to provide positive pressure at its output 11*e* so that buffer liquid flows from the buffer conduit 5' into the first flow cell 3*b* and the second flow cell 3*d*, thereby, all test surfaces within the first cell group 31 are contacted with buffer liquid, thus allowing to establish a sensor baseline for referencing purposes.

Then an injection step is performed so that a first sample, which is present in a first well 1*a* of the sample container 1, is injected into the first and second flow cells 3*a,b* of the first flow cell group 31. To carry out said injection step, the needle unit 2 is positioned such as the tip of first needle 2*a* is submerged in the first sample which is in a first well 1*a* of the sample container 1. Then the injector valve 4 is moved to its first position such as the second fluidic port 4*b* is fluidly connected to the first fluidic port 4*a*. Then the first pumping means 12 is configured to provide negative pressure, thereby the first sample is aspirated from the first well 1*a* and flows through the injector valve 4 into the sample loop 8. Then the injector valve 4 is moved to its second position such as the second fluidic port 4*b* is fluidly connected to the third fluidic port 4*c*. Then the first pumping means 12 is configured to provide positive pressure at its output 12*e*, thereby the first sample flows from the sample loop 8 through the sample injection conduit 5' and into the first flow cell 3*b* and the second flow cell 3*d*; as the first sample flows through the first and second flow cells 3*a,b* in the first flow cell group 31, the first sample will contact the ligands which are present on the test surfaces of each of these respective first flow cells 3*a,b* and if the first sample contains molecules which can bind to the ligands on the test surface of the flow cells 3*a,b* these molecule will become bound as the first sample flows through the flow cells 3*a,b*. Then the first pumping means 12*e* is configured to stop providing positive pressure at its output 12*e*.

Then, optionally a dissociation step is performed; in this example the dissociation step comprises passing a buffer fluid into the first and second flow cells 3*a,b* within the first flow cell group 31; the buffer fluid will promote the dissociation of molecules which are bound to the ligands. Referring to the fluidic assembly 100 in FIG. 1, therefore the second pumping means 11 is configured to provide positive pressure at its output 11*e*, so that buffer liquid flows from the buffer conduit 5' into the first flow cell 3*b* and the second flow cell 3*d*. As the buffer liquid flows through the first and second flow cells 3*a,b*, the test surfaces in these respective flow cells within the first cell group 31 are rinsed with buffer liquid; the rising causes any molecules which are bound to the ligands on the test surface of the first and second flow cells 3*a,b* to become dissociated from those ligands, thereby freeing up the ligands so that they can once again bind to molecules of a sample fluid which is to be screened.

During the injection step, the optional baseline step and the optional dissociation step, the sensor 50 outputs signals which represents the binding and/or dissociation of molecules in the first sample to/from the ligands on the test surfaces of the first and second flow cells 3*a*,3*b*; these signals which is output by the sensor 50 is preferably recorded. The recorded signals will be used in the subsequent damage assessment step.

Optionally, if the first sample was the only sample to be screened then the procedure may be stopped at this point. In this example at least one other sample is to be subsequently screened using the assembly 100.

Optionally, the needle unit 2 is washed to avoid contamination of other samples which are to be subsequently screened using the assembly 100. For example, optionally, the needle unit 2 is washed to avoid contamination of other samples, which are to be subsequently screened using the assembly 100, which are contained in the wells 1' of the sample container 1.

Next, a surface damage assessment step is executed. The surface damage assessment step comprises using at least one of, the sensor signal recorded during the injection step, the sensor signal recorded during the baseline step, and/or the sensor signal recorded during the dissociation step, to determine if the test surface of a flow cell in the selected (addressed) group was damaged by the first sample fluid. The manner in which the damage assessment steps can be carried out using one or more of these signals has already been described above.

If the evaluation of the signal step indicates that the test surfaces of first and/or second flow cells 3*a,b*, are not damaged (in particular that the ligands which are immobilized on the test surfaces of first and/or second flow cells 3*a,b* in the first flow cell group 31, are not damaged), then the above mentioned steps are repeated for the next sample (in this example a second sample) which is present in another one of the wells 1' of the of the sample container 1.

The above steps are repeated for each sample fluid in the sample container 1 until either, all of said plurality of sample fluids have be screened, or, until it is determined in a damage assessment step that the test surfaces of the first and/or second flow cell 3*a,b* in the first flow cell group 31, are damaged (in particular the ligands on the test surface of the first and/or second flow cell 3*a,b* in the first flow cell group 31, are damaged or biologically inactivated). In other words for each sample fluid, the optional baseline step is carried out and the sensor signals are recorded; the sample fluid is then injected into the first and second flow cells 3*a,b* of the first flow cell group 31 of the flow cell unit 3; during injection step the sensor signal which represents the binding of molecules of that sample to the ligands on the test surfaces of the first and second flow cells 3*a,b* is recorded; an optional dissociation step is carried out and the sensor signals are recorded during the dissociation step. One or more of the recorded signals are then use in a assessment step to determine whether the test surfaces of first and/or second flow cells 3*a,b* of the first flow cell group 31, have become damaged (and in particular to determine whether the ligands which are immobilized on the test surfaces of first and/or second flow cells 3*a,b* have become damaged or biologically inactivated). If it is determined in the damage assessment step that the test surfaces of the first and second flow cells 3*a,b* of the first flow cell group 31, are not damaged, then the next sample fluid to be screened is injected into the first and second flow cells 3*a,b* of the first flow cell group 31 (optionally a rinsing step is carried out before the next sample is injected)

If however it is determined in the damage assessment step that the test surfaces of the first and/or second flow cells 3*a,b* of the first flow cell group 31, are damaged, then the second group of flow cells 32 (i.e. third and fourth flow cells 3*c,d*) are selected (addressed) prior to injecting the next sample; the third and fourth flow cells 3*c,d* are used in the screen of subsequent samples (since the test surfaces of the third and fourth flow cells 3*c,d* of the second flow cell group 32, are not damaged and the ligands on said test surfaces of the third and fourth flow cells 3*c,d* are not damaged or biologically inactivated).

Said next sample is screened by performing the same steps as described above as for the first sample, but using the second flow cell group 32.

If the surface damage assessment step indicates that the test surfaces of third and/or fourth flow cells 3*c,d*, in the second group 32 have not been damaged by the last sample, then the above steps are repeated for remaining samples until, either all remaining samples have been screened or until the surface damage assessment step indicates that the test surfaces of third and/or fourth flow cells 3*c,d*, in the second group of flow cells 32 are damaged.

If however, after flowing a second sample through the third and/or fourth flow cells 3*c,d*, in the second group of flow cells 32, the surface damage assessment step indicates that the test surfaces of the third and/or fourth flow cells 3*c,d*, in the second group of flow cells 32, are damaged (in particular that the ligands which are immobilized on the test surfaces of third and/or fourth flow cells 3*c,d*, in the second group of flow cells 32 are damaged or are biologically inactivated), then the screening procedure is interrupted and the flow cells 3*a-d* in at least one of the first and/or second groups of flow cells 31,32 are replaced with a new flow cells; most preferably the flow cells 3*a-d* in both the first and second groups of flow cells 31,32 are replaced with a new flow cells As already mentioned the fluidic assemblies 100, 101,102 are not limited to having only two groups of flow cells 31,32; on the contrary the fluidic assemblies 100, 101,102 may each comprises more than two groups of flow cells, in which case the additional groups of flow cells may be used for screening before having to interrupt the screening procedure to replace the flow cells. In other words, to generalize, only if the surface damage assessment steps indicate that the test surface of at least flow cell in every group of flow cells in the assembly, is damaged, only then is the screening process stopped since there is no more flow cell groups which have only flow cells with undamaged test surfaces. If on the other hand the there are more or more flow cell groups available in the assembly in which all of the flow cells of the group have undamaged test surfaces, then one of these available flow cells are selected and used to screening subsequent sample fluids.

The above-mentioned steps are then repeated for each of the remaining sample so that each sample in the wells 1' of the sample container 1 is screened.

The fluidic assembly 102 depicted in FIG. 3 can be used to implement another exemplary method of screening samples according to a further embodiment of the present invention; specifically the method is for screening samples for binding to ligands immobilized or captured on the test surfaces of the flow cells 3*a-d* present in the first and second groups of flow cells 31,32 of the flow cell unit 3. In this embodiment and in variation to the previously described method, ligands are only immobilized or captured on the test surfaces of the flow cells 3*a,b* in the first flow cell group 31 prior to injecting the first sample fluid into the first flow cell group 31. Furthermore ligands are only immobilized or captured on the test surfaces of the flow cells 3*c,d* in the second flow cell group 32 only if the damage assessment step indicates that the test surface of a flow cell in the first flow cell group 31 is damages, and only prior to injecting the sample fluid into the second flow cell group 32. In particular, if the surface damage assessment step results in the conclusion that a test surface within the first flow cell group 31 is damaged, then an immobilization step is executed to immobilize ligands on the test surface of the third and fourth flow cells 3*c,d* in the second flow cell group 32, before sample fluids are injected into the flow cells 3*c,d* of the second flow cell group 32.

The invention claimed is:

1. A method of screening a plurality of sample fluids for molecules which can bind to predefined ligands, using an assembly comprising, a sample delivery unit which can receive sample fluids to be screened, and a plurality of groups of flow cells, each group having at least two flow cells, each group comprising at least one flow cell which has a test surface having a first type of ligand and another flow cell which serves as a reference flow cell, and a means for selectively fluidly connecting the sample delivery unit to any one of said groups of flow cells, the method comprising the steps of, selecting one of said plurality of flow cell groups by fluidly connecting said flow cell group to the sample delivery unit;

carrying out an injection step which comprises injecting a sample fluid to be screened from the sample delivery unit into the flow cells in the selected flow cell group;

for each flow cell in the selected flow cell group, recording a signal which is output from a sensor, wherein said signal represents the binding of molecules of the sample fluid to ligands on the test surface of that flow cell and/or the dissociation of molecules from ligands on the test surface of that flow cell;

carrying out a damage assessment step, using said recorded signals, to determine if the test surface of a flow cell in the selected flow cell group is damaged;

if it is determined from the damage assessment step that the test surface of a flow cell in the selected flow cell group is damaged, then selecting another one of said plurality of flow cell groups by fluidly connecting said other flow cell group to the sample delivery unit.

2. A method according to claim 1, further comprising the steps of, carrying out an injection step which comprises injecting a next sample fluid to be screened from the sample delivery unit into the flow cells in said selected other flow cell unit;

for each flow cell in the selected other flow cell group, recording a signal using the sensor which represent the binding of molecules of the sample fluid to ligands on the test surface of that flow cell and/or the dissociation of molecules from ligands on the test surface of that flow cell;

carrying out a damage assessment step, using said recorded signals, to determine if the test surface of a flow cell in the selected other flow cell group is damaged;

if it is determined from the damage assessment step that the test surface of a flow cell in the selected other flow cell group is damaged, then selecting another one of said plurality of flow cell groups by fluidly connecting said other flow cell group to the sample delivery unit, provided that there is another flow cell group in the assembly, which is without flow cells which have a damaged test surface.

3. A method according to claim 1, wherein, if it is determined from the damage assessment step that the test surface of a flow cell in the selected other flow cell group is damaged, but there is no other flow cell group in the assembly which is without flow cells which have a damaged test surface, then, carrying out the step of replacing the flow cells in each flow cell group in the assembly with flow cells which each have undamaged test surfaces.

4. A method according to claim 1, wherein said at least one flow cell which has a test surface having a first type of ligand comprises at least one active flow cell with a test surface having ligands which can bind to molecules of a sample fluid, and wherein said other flow cell which serves as a reference flow cell comprises at least one reference flow cell which either has no ligands on its test surface or has reference ligands on its test surface, and wherein the method further comprises the step of, recording a signal using the sensor which represents the binding of molecules of the sample fluid to ligands on the test surface of the active flow cell of the selected group;

recording a signal using the sensor which represents the binding of molecules of the sample fluid to test surface of the reference flow cell of the selected group;

subtracting the signal which is recorded from the reference flow cell from the signal which is recorded from the active flow cell, to provide a modified recorded sensor signal;

and wherein the step of carrying out a damage assessment step, using said recorded signal, to determine if the test surface of a flow cell in the selected flow cell group is damaged, comprises carrying out a damage assessment step, using said modified recorded sensor signal.

5. A method according to claim 4, wherein the method comprises recording signals which are output from said sensor during a baseline step and dissociation step and also recording signals from said sensor during the injection step; and wherein the step of carrying out a damage assessment step using said modified recorded sensor signal comprises, calculating the average (R(tb)) of the modified recorded sensor signal at at least one point in time (tb) which is during the time period when the baseline step was being carried out, and calculating the average (R(td)) of the modified recorded sensor signal at said at least at one point in time (td) which is during the time period when the dissociation step was being carried out;

comparing the difference between the average (R(td)) of the modified recorded sensor signal at time td during the dissociation step and the average (R(tb)) of the modified recorded sensor signal at time tb during the baseline step, to a predefined threshold average value (R1);

determining that the test surface of the active flow cell in the flow cell group is damaged if the difference between the average (R(td)) of the modified recorded sensor signal at time td and the average (R(tb)) of the modified recorded sensor signal at a time tb, is greater than the threshold average value R1; or determining that the test surface of the active flow cell in the flow cell group is not damaged if the difference between the average (R(td)) of the modified recorded sensor signal at time td and the average (R(tb)) of the modified recorded sensor signal at a time tb, is less than the threshold average value R1.

6. A method according to claim 4, wherein the method comprises recording signals which are output from said sensor during a baseline step and dissociation step, and wherein the step of carrying out a damage assessment step using said modified recorded sensor signal comprises, calculating the average (R(tb)) of the modified recorded sensor signal at at least one point in time (tb) which is during the time period when the baseline step was being carried out; and calculating the average (R(td)) of the modified recorded sensor signal at said at least at one point in time (td) which is during the time period when the dissociation step was being carried out;

calculating the slope M(td') of the modified recorded sensor signal at said at least one point in time (td') which is during the time period when the dissociation step was being carried out;

comparing the difference between the average (R(td)) of the modified recorded sensor signal at time td during the dissociation step and the average (R(tb)) of the modified recorded sensor signal at time tb during the baseline step, to a predefined threshold average value (R1);

comparing the calculated slope M(td') with a threshold slope value M1;

determining that the test surface of the active flow cell in the flow cell group is damaged if the difference between the average (R(td)) of the modified recorded sensor signal at time td and the average (R(tb)) of the modified recorded sensor signal at a time tb, is greater than the threshold average value R1, and the slope (M(td')) of the modified recorded sensor signal at a time td' is greater than the threshold slope value M1; or determining that the test surface of the active flow cell in the flow cell group is not damaged if the difference between the average (R(td)) of the modified recorded sensor signal at time td and the average (R(tb)) of the modified recorded sensor signal at a time tb, is less than the threshold average value R1, and the slope (M(td')) of the modified recorded sensor signal at a time td' is less than the threshold slope value M1.

7. A method according to claim 4, wherein the method comprises recording signals which are output from said sensor during a baseline step and dissociation step, and also recording signals from said sensor during the injection step; and wherein the step of carrying out a damage assessment step using said modified recorded sensor signal comprises, calculating the average (R(tb)) of the modified recorded sensor signal at at least one point in time (tb) which is during the time period when the baseline step was being carried out, and calculating the average (R(td)) of the modified recorded sensor signal at said at least at one point in time (td) which is during the time period when the dissociation step was being carried out;

calculating the average (R(ti)) of the modified recorded sensor signal at said at least one point in time (ti) which is during the time period when the injection was being carried out;

comparing the difference between the average (R(td)) of the modified recorded sensor signal at time td during the dissociation step and the average (R(tb)) of the modified recorded sensor signal at time tb during the baseline step, to a threshold value R1(R(ti)) which is a function of the average (R(ti)) of the modified recorded sensor signal at time ti during injection step;

determining that the test surface of the active flow cell in the flow cell group is damaged if the difference between the average (R(td)) of the modified recorded sensor signal at time td and the average (R(tb)) of the modified recorded sensor signal at a time tb, is greater than said threshold value R1(R(ti)); or determining that the test surface of the active flow cell in the flow cell group is not damaged if the difference between the average (R(td)) of the modified recorded sensor signal at time td and the average (R(tb)) of the modified recorded sensor signal at a time tb, is less than said threshold value R1(R(ti)).

8. A method according to claim 7 wherein the threshold value R1(R(ti)) which is a function of the average (R(ti)) of the modified recorded sensor signal at time ti during injection step takes the form: r·R(ti), wherein r is a predefined value greater than '0' but less than '1' and R(ti)) is the average of the modified recorded sensor signal at time ti during injection step.

9. A method according to claim 4, wherein the step of carrying out an injection step which comprises injecting a sample fluid to be screened from the sample delivery unit into the flow cells in the selected flow cell group, and injecting one or more reference sample fluids from the sample delivery unit into the flow cells in the selected flow cell group, wherein a reference sample is a sample which is a priori known to have molecules which bind to ligands on the test surface of a flow cell in the selected flow cell group and, wherein the method comprises recording sensor signal is recorded during a baseline step carried out for the one or more reference sample fluids, and also recording signals from said sensor during the injection step one or more reference sample fluids; and wherein the step of carrying out a damage assessment step using said modified recorded sensor signal comprises, calculating the average (R(tb)) of the modified recorded sensor signal at at least one point in time (tb) which is during the time period when the baseline step was being carried out, and calculating the average (R(ti)) of the modified recorded sensor signal at said at least one point in time (ti) which is during the time period when the injection was being carried out;

comparing the difference between the average (R(ti)) of the modified recorded sensor signal at said at least one point in time (ti) which is during the time period when the injection was being carried out and the average (R(tb)) of the modified recorded sensor signal at time tb which is during the time period when the baseline step was carried out, to a predefined threshold average value (R2), either, determining that the test surface of the active flow cell in the flow cell group is not damaged if the difference between the average (R(ti)) of the modified recorded sensor signal at time ti and the average (R(tb)) of the modified recorded sensor signal at a time tb, is smaller than said predefined threshold average value (R2), or, determining that the test surface of the active flow cell in the flow cell group is not damaged if the difference between the average (R(ti)) of the modified recorded sensor signal at time ti and the average (R(tb)) of the modified recorded sensor signal at a time tb, is greater than said predefined threshold average value (R2).

10. A method according to claim 4 wherein the step of carrying out a damage assessment step, using said modified recorded sensor signal comprises determining the average of the modified recorded sensor signal, at a particular point in time (td, tb, ti), by summing points of the modified recorded sensor signal, over a predefined section of the modified recorded sensor signal, to obtain a total, and dividing said total by the number of points which were summed.

11. A method according to claim 10 wherein the predefined section of the modified recorded sensor signal has a duration of 0.1 seconds, or 0.2 seconds, or 0.5 seconds, or one second, or two seconds, or three seconds or five seconds.

* * * * *